US009618310B2

(12) United States Patent
Brent et al.

(10) Patent No.: US 9,618,310 B2
(45) Date of Patent: Apr. 11, 2017

(54) METHOD OF BLASTING MULTIPLE LAYERS OR LEVELS OF ROCK

(71) Applicant: Orica Explosives Technology Pty Ltd, Melbourne, Victoria (AU)

(72) Inventors: Geoffrey Frederick Brent, Valentine (AU); Tapan Goswami, Lakeslands (AU)

(73) Assignee: Orica Explosives Technology Pty Ltd, Melbourne (AU)

( * ) Notice: Subject to any disclaimer, the term of this patent is extended or adjusted under 35 U.S.C. 154(b) by 0 days.

(21) Appl. No.: 13/932,639

(22) Filed: Jul. 1, 2013

(65) Prior Publication Data

US 2013/0298795 A1 Nov. 14, 2013

Related U.S. Application Data

(62) Division of application No. 10/596,066, filed on Apr. 12, 2007, now Pat. No. 8,631,744.

(30) Foreign Application Priority Data

Nov. 28, 2003 (AU) ..... 2003906600

(51) Int. Cl.
*F42D 3/00* (2006.01)
*F42D 3/04* (2006.01)
*F42D 1/055* (2006.01)

(52) U.S. Cl.
CPC ..... *F42D 3/04* (2013.01); *F42D 1/055* (2013.01)

(58) Field of Classification Search
CPC ..... F42D 3/04; F42D 1/055
(Continued)

(56) References Cited

U.S. PATENT DOCUMENTS 5,140,907 A 8/1992 Svatek
5,194,689 A 3/1993 Cummins
(Continued)

FOREIGN PATENT DOCUMENTS

AU 199919543 9/1999
AU 200053560 A 3/2001
(Continued)

OTHER PUBLICATIONS

Williams et al. "Simultaneous Blasting of Multiple Overburden Seams in Surface Coal Mining". International Society of Explosives Engineers. 1992. pp. 1-10.*
(Continued)

*Primary Examiner* — Gabriel Klein
(74) *Attorney, Agent, or Firm* — Fish & Richardson P.C.

(57) ABSTRACT

A method of blasting plural layers of material in a blastfield that reduces the amount of mechanical excavation required to expose a lower layer of material. The method includes using rows of equally spaced blastholes that pass through all of the layers and additional intermediate rows of blastholes that pass down only through the top layer. Each blasthole is capped with stemming material and includes one or more decks of explosive material and detonators, which air decks or inert stemming separating adjacent explosive decks. The detonators in layer are detonated first in order from row rearwards to throw a substantial amount of the blast material from the layer forwardly of free face onto the floor. In the same blasting cycle and within seconds of the throw blast, explosives materials in layers are detonated in a stand-up blast in which material in layers are broken up but otherwise are minimally displace or thrown forwardly.

29 Claims, 9 Drawing Sheets

(58) Field of Classification Search
USPC ..... 102/301, 311–313; 166/63, 299; 299/13
See application file for complete search history.

(56) References Cited

U.S. PATENT DOCUMENTS

| | | | |
|---|---|---|---|
| 5,388,521 | A | 2/1995 | Coursen |
| 5,392,712 | A | 2/1995 | Waldock |
| 5,413,047 | A | 5/1995 | Evans et al. |
| 5,585,591 | A | 12/1996 | Waldock |
| 5,596,164 | A | 1/1997 | Waldock |
| 6,085,659 | A | 7/2000 | Beukes et al. |
| 6,520,591 | B1 | 2/2003 | Jun et al. |
| 6,655,289 | B1 | 12/2003 | Bornheim et al. |
| 6,772,105 | B1 | 8/2004 | Heck, Sr. |
| 7,052,092 | B2 | 5/2006 | Collinsworth et al. |
| 7,406,918 | B2 | 8/2008 | Brent et al. |
| 7,707,939 | B2 | 5/2010 | Brent et al. |

FOREIGN PATENT DOCUMENTS

| | | | |
|---|---|---|---|
| AU | 784685 | | 10/2003 |
| AU | 2004293486 | | 7/2009 |
| CA | 2302166 | | 1/2000 |
| EP | 0 601 831 | | 6/1994 |
| KR | 2003009743 | | 2/2003 |
| SU | 976751 | A2 | 1/1984 |
| WO | WO02057707 | A1 | 7/2002 |
| WO | 2005052499 | | 6/2005 |

OTHER PUBLICATIONS

S.S. Kanchibotla, A. Cocker, A. Scott. "ACARP Project C5005 Understanding and Controlling Coal Damage during Coal Blasting". Australian Coal Association Research Program. Feb. 1999.*
Dynoconsult Project Team, "ACARP Project C11051—Controlling Block Movement of Coal During Overburden Blasting", Phase 2 Interim Report—Rix's Creek Mine, pp. 1, Mar. 2003.
Edwards et al., "Economics of Blasting Around Steep Dipping Coal Seams at the Mt. Owen Mine", Seventh High Tech Seminar, Blasting Technology, Instrumentation and Explosives Applications, Orlando, Florida, pp. 1-36, Jul. 28-Aug. 1, 1997.
Goswami et al., "Practical Aspects of Cast Blasting at Bulga Coal Australia", Proceedings of the Twenty-Fifth Annual Conference on Explosives and Blasting Technique, Nashville, Tennessee, vol. II, pp. 1-13, Feb. 7-10, 1999.
Grobler, "Using Electronic Detonators to Improve All-Round Blasting Performances", EXPLO, Hunter Valley, NSW, pp. 276-279, Oct. 2001.
"Safe and Efficient Blasting in Surface Coal Mines," ICI Australia Operations, pp. 2.13-2.15, 9.14, and 9.15, 1993.
Kanchibotla et al., "Application of Baby Deck Initiation to Reduce Coal Damage During Cast Blasting", International Journal of Surface Mining, Reclamation and Environment 14:75-85, 2000.
Kanchibotla, "Control of Coal Damage Due to Overburden Cast Blasting", The Australian Coal Review, pp. 15-18, Oct. 1999.
Kanchibotla, "Optimum Blasting? Is it Minimum cost Per Broken Rock or Maximum Value Per Broken Rock", pp. 35-40, EXPLO 2001, Hunter Valley, NSW, Oct. 28-31, 2001, published by The Australasian Institute of Mining and Metallurgy.
Kukla et al., "Open Pit Mining", Australasian Coal Mining Practice, Monograph pp. 203-215, 1986.
Onederra et al., "Selection of Inter-hole and Inter-row Timing for Surface Blasting—an Approach Based on Burden Relief Analysis", Explosives and Blasting Technique, Holmberg (ed.), Proceedings of EFEE Second World Conference on Explosives and Blasting Technique, Prague, Czech Republic, pp. 269-275, Sep. 10-12, 2003.
Singh, "New Trends in Drilling and Blasting Technology", International Journal of Surface Mining, Reclamation and Environment 14:305-315, 2000.
Spathis, "Muckpile Shape Predictions from Measured Burden Velocity Distributions", Proceedings of the Fourth International Symposium on Rock Fragmentation by Blasting—FRAGBLAST-4 Vienna, Austria, Rock Fragmentation by Blasting, pp. 233-238, 1993.
Technical Information Services, Technical Information Database—ISEE Proceedings/Abstracts hhtp://isee.org/tis/Proceed/General/92gen/92genlist.htm, pp. 1-3, Jul. 20, 2010.
Williams et al., "Simultaneous Blasting of Multiple Overburden Seams in Surface Coal Mining," International Society of Explosives Engineers, 1992, pp. 1-10.
Woolf et al, "Strategy, Innovation and Change—Challenging the Future at the Gregg River Mine", Journal of Explosives Engineering, vol. 11, No. 6, pp. 8-46, 1994.
Paul Harrison, "Statement of Grounds and Particulars", In the Matter of Australian Patent Application No. 2004293486 in the name of Orica Explosives Technology Pty Ltd. And in the Matter of Opposition thereto by Dyno Nobel Inc., 19 pages, Oct. 2, 2009.
"Statutory Declaration of Michael Humphreys", In the Matter of Australian Patent Application No. 2004293486 in the name of Orica Explosives Technology Pty Ltd. And in the Matter of Opposition thereto by Dyno Nobel Inc., 40 pages, Jul. 30, 2010.
"Statutory Declaration of Sarma Kanchibotla", In the Matter of Australian Patent Application No. 2004293486 in the name of Orica Explosives Technology Pty Ltd. And in the Matter of Opposition thereto by Dyno Nobel Inc., 17 pages, Oct. 29, 2010.
Burrell M.J., Innovative Blasting Practice at Sands Hill Coal Company, Proceedings of the 16th Annual Conference on Explosives and Blasting Technique Orlando, Florida, USA, International Society of Explosives Engineers, 1990, pp. 1-4.
Campbell, Richard, A., "Multiple Seam Surface Mining", Mining Congress Journal, vol. 56(8), pp. 71-75, 1970.
Chironis, N.P., "Blast Casting Succeeds at Multi-Seam Western Mine", Coal Age, November, vol. 90(11), pp. 55-58, 1985.
Chung S.H. et al., "Computer Design and Field Application of Sub-Seam and Multi-Seam Blasts in Steeply Dipping Coal Seams", Proceedings of the Eleventh Conference on Explosives and Blasting Technique, San Diego, California, USA, International Society of Explosives Engineers, 1985, pp. 42-48.
Jackson, Dan, "Multi-Seam Surface Mining in West", Coal Age, March, vol. 82 (No. 3), 1977, pp. 64-70.
Laybourne R.A., et al., "The Unique Combination of Drilling and Blasting Problems Faced by New Vaal Colliery, RSA", 95th Annual General Meeting, Petroleum Society of CIM, 1993, No. 93, CIM Montreal.
Mandal, S.K. et al., "Segregation of coal by single-shot blasting of composite strata in opencast mines", Institution of Mining and Metallurgy, ISSN: 0371-7844, 2001, pp. A69-A72.
McDonald, K.L. et al., "Productivity improvements for dragline operations using controlled blasting in a single- and multiple-seam opencast coal operation at Rietspruit, South Africa", CIM Bulletin, vol. 76, No. 851, 1983, pp. 154-156.
Merritt, Paul, C., "Kentucky Mine Finds Rewards in Cast Blasting", Coal Age, December, vol. 92 (12), 1987, pp. 66-67.
Orica Explosives, Safe and Efficient Blasting in Surface Coal Mines, Chapter 10, 1998, pp. 156-159.
White, P.E. et al. "Controlled Blasting in a Double-Seam Opencast Operation as applied at Rietspruit", Papers and Discussions—Association of Mine Managers, South Africa, 1982, pp. 351-390.
S. Kanchibotla, P. Grouhel, M. Tucker, K. Podoliak, "ACARP Project C11051—Controlling Block Movement of Coal During Overburden Blasting" Australian Coal Association Research Program, Sep. 2004.
S.S. Kanchibotla, A. Cocker, A. Scott, "ACARP Project C5005 Understanding and Controlling Coal Damage during Coal Blasting" Australian Coal Association Research Program, Feb. 1999.
Supplementary European Search Report, European Application No. EP 04 76 1429, 2 pages, Completion date Aug. 18, 2010.
ACARP, Final Report: The Assessment and Control of Coal Damage and Loss, Sep. 1995, 280 pages.
ACARP, Final Report: Understanding and Controlling Coal Damage during Cast Blasting, Feb. 1999, 137 pages.

(56) References Cited

OTHER PUBLICATIONS

ACARP, Final Report: Controlling Block Movement of Coal During Overburden Blasting, Sep. 2004, 169 pages.
ACARP Project C11051: Controlling Block Movement of Coal During Overburden Blasting, Mar. 2003, 40 pages.
AECI Explosives Limited: Blasting in Opencase Mines and Quarries, ICI Explosives Limited, Australia, 1995, 5 pages.
Bierei, Gregg R., "Arch of Illionois—look to the future", Mining Engineering, Oct. 1993, 3 pages.
Brent et al., "Assessment of Presplits formed using Electronic Delay Detonators at Mt. Thorley Mine", ICI Australia Operations Pty Ltd., 1995, 37 pages.
Brent et al., "High Performance Throw Blasting with i-kon Electronic Detonators in an Environmentally Sensitive Area at Stratford Coal, NSW, Australia", International Society of Explosive Engineers, 2003, 12 pages.
Brent et al., "Throw Blasting Analysis", Fragblast-8, Santiago, Chile, May 2006, 7 pages.
Brent et al., "Throw blasting analysis—a focus on coal uncovery and recovery rates", Rock Fragmentation by Blasting, Sandchidrian (ED), 2010, 6 pages.
Brent, Geoffrey, "Blasting into the future", World Coal, Aug. 2002, 3 pages.
Brent et al., "Studies on the Effect of Burden on Blast Damage and the Implementation of New Blasting Practices to Improve Productivity at KCGMs Fimiston Mine", Fragblast, 2002, vol. 6, No. 2, pp. 189-206.
Brent, Geoffrey, "The Design of Pre-split Blasts", EXPLO '95 Conference, Sep. 1995, 7 pages.
Brent et al., "Summary Report for Boral Electronic Blasting Systems Trial at Boral Deer Park Quarry", Orica Australia Pty Ltd, 1999-2000, 37 pages.
Brent et al., "Trial of electronic delay detonators in a presplit at Mt. Thorley Mine", Orica Australia Pty Ltd, 1999, 14 pages.
Chiapetta, R. Frank., "Choosing the Right Delay Timing for the Blasting Application, Optimization and Maintaining Field Controls", International Society of Explosive Engineers, 2001, 36 pages.
Chung et al., :Benefits of Using DMC_Blast in Open Pit and Underground Mining, The Proceedings of the Twenty-Eighth Annual Conference on Explosives and Blasting Technique, vol. II, Feb. 2002, 9 pages.
Chung et al., "Advanced blast modeling for mining steeply dipping coal seems", Mine Planning and Equipment Selection, Shanghai (ED), 1998, 8 pages.
Curtis, Richard, "Optimizing Dragline Stripping Capacity versus Productivity for Six Different Mining Methods, Including Casting", Fourth High-Tech Seminar, Blasting Technology, Instrumentation and Explosives Applications, Jun. 1992, 28 pages.
Deacon et al., "Improved Blast Control through the use of Programmable Delay Detonators", International Society of Explosive Engineers, 1997, 12 pages.
Dunn et al., "Pre-Splitting—Wall Control for Surface Coal Mines", EXPLO '95 Conference, Sep. 1995, 8 pages.
Edwards et al., "Economics of Blasting Around Steep Dipping Coal Seams at the Mt. Owen Mine", Seventh High Tech Seminar, Blasting Technology, Instrumentation and Explosives Applications, 1997, 36 pages.
Goswami et al., "Economic and safety benefits of Stratablast for steeply dipping coal seams—a case study", International Society of Explosive Engineers, 2010, 7 pages.
Goswami et al., "Reducing Coal Damage and Loss with a New Blasting Technology", International Society of Explosive Engineers, 2008, 16 pages.
Goswami et al., "Stratablast in Action", International Society of Explosive Engineers, 2006, 15 pages.
Goswami et al., "Winning thin coal seams with Stratablast—improving coal recovery and sustainability at Anglo Coal's Drayton Mine", International Society of Explosive Engineers, 2010, 14 pages.
ICI Explosives Blasting Guide, ICI Explosives Technical Services, Australia, Nov. 1995, 4 pages.
"In Situ Blasting", Proceedings of the Twenty-Fifth Annual Conference on Explosives and Blasting Technique, International Society of Explosive Engineers, Feb. 1999, 3 pages.
Jorgenson, G.K., "Computer Modelling of Cast Blasting", CIM 1988 District Six Meeting, International Society of Explosive Engineers, 2001, 20 pages.
Kanchibolta, S. S., "Optimum Blasting? Is it Minimum Cost Per Broken Rock or Maximum Value Per Broken Rock?", EXPLO 2001, 8 pages.
Kanchibolta, S. S., "Application of baby deck initiation to reduce coal damage during cast blasting", International Journal of Surface Mining, Reclamation and Environment, 14, 2000, pp. 75-85.
Kanchibolta, S. S., "Control of Coal Damage Due to Overburden Cast Blasting", The Australian Coal Review, Oct. 1999, 4 pages.
Laing et al., "Reducing Coal Loss During Cast Blasting At Rix's Creek Mine", International Society of Explosive Engineers, 2006, 13 pages.
Laybourne et al., "The Unique Combination of Drilling and Blasting Problems Faced by New Vaal Colliery", 95th Annual General Meeting of CIM, 1993, 21 pages.
Mandal et al., "Segregation of coal by single-shot blasting of composite strata in opencast mines", The Institution of Mining Engineers, 1998, 4 pages.
McDonald et al., "Productivity improvements for dragline operations using controlled blasting in a single and multiple-seam opencast coal operation at Riestspruit, South Africa", Canadian Mining and Metallurgical Bulletin, vol. 76, No. 851, Mar. 1983, 4 pages.
Cunningham, Claude, 'Nine Years of Blasting Experience with Electronic Delay Detonators', Years of Blasting Experience with Electronic Delay Detonators, 2003, 17 pages.
Nontel Detonators Brochure, Dyno Nobel, Nov. 2001, 38 pages.
Onederra et al., "Explosives and Blasting Technique", Proceedings of EFEE Second World Conference on Explosives and Blasting Technique, Sep. 2003, 9 pages.
Rough History of EBS Commercialisation, 2010, 3 pages.
Safe and Efficient Blasting in Surface Coal Mines, ICI Explosives, Technical Services, 1993, 4 pages.
Safe and Efficient Blasting in Surface Coal Mines, Orica Australia Pty Ltd, Technical Services, 1998, 3 pages.
Sengstock, G. W., "Blast Profile Control for Dragline Productivity Optimisation", Third Large Open Pit Mining Conference, 1992, 6 pages.
Spathis, A. T., "Muckpile shape predictions from measured burden velocity distributions", Rock Fragmentation by Blasting, Rossmanith (ED), Proceedings of the Fourth International Symposium on Rock Fragmentation by Blasting, 1993, 8 pages.
Williams et al., "Simultaneous Blasting of Multiple Overburden Seams in Surface Coal Mining", International Society of Explosive Engineers, 2000, 10 pages.
Workman et al., "A Method for Calculating the Weight of Charge to use in Large Hole Pre-Splitting for Cast Blasting Operations", International Society of Explosive Engineers, 2000, 9 pages.
Atlas Powder Company, "Explosives and Rock Blasting", Atlas Powder Company Field Technical Operations, 1987, 6 pages.
Baker et al., "Utilising Electronic Detonators at Hail Creek Mine for 'Dynamic Buffering'", EXPLO Conference, Nov. 2011, 5 pages.
Bock et al., "An economic model for gold and platinum mining using selective blast mining", The Journal of South African Institute of Mining and Metallurgy, Apr. 1998, 10 pages.
Cunningham, Claude, "Nine Years of Blasting Experience with Electronic Delay Detonators", International Society of Explosive Engineers, vol. 2, 2002, 17 pages.
Dyno Nobel Brochure, "Controlling Block Movement of Coal During Overburden Blasting", Dyno Nobel, 2012, 2 pages.
Dyno Nobel Product Manual, "NONEL® and PRIMACORD®", Dyno Nobel, 2005, 4 pages.
Giltner, S.G., "Potentional Blast Designs for the Application of BBB (Barricadeless, Blasted Backfill) in Gold Mining", Chamber of Mines of South Africa Research Organization, Jul. 1987, 24 pages.

(56) References Cited

OTHER PUBLICATIONS

Hummer et al., "Elimination of Two-Pass Benching at Colowyo Coal", Proceedings of the Twenty-Ninth Annual Conference on Explosives and Blasting Technique, Feb. 2003, 7 pages.
Humphreys, M., "Monitoring and Analysis of Blasting at Ravensworth Mine", Main Dig Shot, R716S-R1—#1, Apr. 1993, 28 pages.
Kanchibotla et al., "Electronic Detonators—Following a Scientific Process to Sustain Maximum Value", EXPLO 2004, Jul. 2004, 7 pages.
"Characteristics of Excavation Equipment", Open Blast Pit Design: Analysis and Optimisation, Julius Kruttschnitt Mineral Research Centre, Queensland, Australia, 1996, 4 pages.
Marton, Alex, "Ski Jump Blast Design to Reduce Strip Mine Coal Losses", The AusIMM, Explosives in Mining Workshop, Melbourne, Victoria, Australia, Nov. 1988, 12 pages.
Moehle, H., "Improving the trough opening process at Premier Mine utilizing Electronic Delay Detonators", FRAGBLAST, 1999, 11 pages.
Nagarajan et al., "Increasing Mine Profitability—Technical Partnership to Reduce Coal Loss", Hunter Valley, NSW, Oct. 28-31, 2001, 4 pages.
Patrick et al., "Minimising Coal Edge Losses in Dragline Blasting Operations", The AusIMM, Explosives in Mining Workshop, Melbourne, Victoria, Australia, Nov. 1988, 6 pages.
Preece et al., "Expanded Rock Blast Modeling Capabilities of DMC_BLAST, Including Buffer Blasting", 13th Annual Symposium on Explosives and Blasting Research of the International Society of Explosive Engineers, Las Vegas, NV, Feb. 1997, 10 pages.
Reisze, William J., "Concepts for Better Blasting", International Society of Explosive Engineers, vol. 1, 2002, 16 pages.
Rock, J., "Comparison of Pyrotechnic and Electronic Initiation Systems at Whitehaven Coal Mine", Fifth Large Open Pit Conference, Kalgoorlis, Western Australia, Nov. 2003, 5 pages.
Rosenstock, Winfried, "The Burton Coal Mine Case", International Society of Explosive Engineers, vol. 2, 2002, 28 pages.
Tucker, G.B., "The use of electronic blasting systems at the M.I.M. George Fisher mine", Explosives & Blasting Technique, Holmberg (ed)., 2000, 6 pages.
Blast Timing and Design Configuration Brochure—Dyno Nobel—Blast Dynamics, Inc., Mar. 1993, 20 pages.
Brent et al., "Matched pairs blasting technique to quantify the benefits of i-kon electronic initiation system", Orica Australia Mining Services, Australia, Sep. 13-16, 2005; 8 pages.
Brent et al., "Throw Blasting with the I-KON System at Drayton Coal Mine ES14 Strip", Orica Australia Pty Ltd, 1999-2000; 7 pages.
Goswami et al., "Practical Aspects of Cast Blasting at Bulga Coal Australia", Technical Services, Orica Explosives, Australia, Proceedings of he 25th Annual Conference on Explosives & Blasting Technique, 1999; Nashville, Tennessee, pp. 207-219.
Goswami et al., "Multiple Strata Blasting—A New Mining Method", 2006; 13 pages.
Goswami et al., "Reducing Coal Damage and Loss with Stratablast", Orica Mining Services, Australia, 2008; 15 pages.
Kukla et al., "Open Pit Mining", Australasian Coal Mining Practice: Chapter 14, Monograph, edited by C.H. Martin, 1986, 13 pages.
Optimal Blasting Techniques for Surface Mining Brochure, 5 pages.
Flexural Rupture (A Gas Expansion Theory), Atlas Powder Company, Explosives & Rock Blasting, Field Technical Operations, Dallas, Texas, 1987, pp. 181-183.
Bierei, "Arch of Illinois—Look to the Future", Journal of Mining Engineering, pp. 1245-1247, Oct. 1993.
CIM Bulletin, "The Canadian Mining and Metallurgical Bulletin", p. 1, Mar. 1983.
Chiappetta, "Choosing the Right Delay Timing for the Blasting Application, Optimization and Maintaining Field Controls", Eighth High Tech Seminar Blasting Technology, Instrumentation and Explosives Applications, Nashville, Tennessee, USA, pp. 1-36, Jul. 20-24, 1998.
Chung et al., "Advanced Blast Modeling for Mining Steeply Dipping Coal Seams", Eighth High Tech Seminar, Blasting Technology, Instrumentation and Explosives Applications, Nashville, Tennessee, pp. 1-12, Jul. 20-24, 1998.
Chung et al., "Benefits of Using DMC_Blast in Open Pit and Underground Mining", Proceedings of the Twenty-Eight Annual Conference on Explosives and Blasting Technique, Las Vegas Nevada, USA, vol. II, International Society of Explosives Engineers, Feb. 10-13, 2002.
Curtis et al., "Optimizing Dragline Stripping Capacity Versus Productivity for Six Different Mining Methods, Including Casting", Fourth High-Tech Seminar, Blasting Technology, Instrumentation and Explosives Applications, Nashville, Tennessee, USA, pp. 1-28, Jun. 20-25, 1992.
Bieniawski, Z.T., "Rock Mechanics in Mining and Tunnelling"; p. 74; A.A.Balkema, Rotterdam, Boston USA (1984).
Blair, B.E., "Use of high-speed camera in blasting studies", U.S. Dept. of the Interior, Bureau of Mines; p. 1-32 (1960).
Brent, G. F., et al "Matched pairs blasting technique to quantify the benefits of electronic blasting" Proceedings of Third EFEE World Conference on Explosives and Blasting, Edited by R. Holmberg et al; p. 481-488; (Sep. 13-16, 2005).
Dare-Bryan, P., et al "Numerical modelling and electronic initiation to assist in blasting heavily jointed rock", Proc. of the 36th Annual Conference on Explosives and Blasting Technique; Int. Society of Explosives Engineers, vol. 2; p. 75-84; Orlando, Florida, USA, Feb. 7-10, 2010.
Dare-Bryan, P.C., et al "Blast optimisation through computer modelling of fragmentation, heave and damage", Proc. 10th International Symposium on Rock Fragmentation by Blasting; p. 95-104; New Delhi, India, Nov. 26-29, 2012b.
Dare-Bryan, P.C., et al "Computer modelling of cast blasting to calculate the variability of swell in a muckpile", Proc. 10th International Symposium on Rock Fragmentation by Blasting; p. 283-293; New Delhi, India, Nov. 26-29, 2012a.
Floyd, J.L, "Increasing cast blasting benefit with the use of high speed motion picture photography and analysis"; International Symposium on Rock Fragmentation by Blasting. vol. 2. Luleå University of Technology; p. 364-380; Steamboat Springs, Colorado, USA (1987).
Furtney, J.K., "Developments in numerical modelling of blast induced rock fragmentation: Updates from the HSBM project", Rock Fragmentation by Blasting: Proceedings of the 9th Int. Symp. on Rock Fragmentation by Blasting. Fragblast 9; p. 35-342 (2009).
Goswami, T., et al "Stratablast, A New Mining Method" Proceedings of the Annual Conference on Explosives and Blasting Techniques, 32nd Conference; p. 1-12; Dallas, Texas, USA, Jan. 29, 2006.
Humphreys, M., et al "Blast Optimisation for Improved Dragline Productivity" Proc. 20th Ann. Conf. on Explosives and Blasting Technique; p. 157-172, ISEE (1994).
ICI Australia Operations Pty Ltd explosives Division, "Safety and Efficiency in Quarry Blasting", Course Manual; Chapter 13; Sydney, NSW, Australia, Mar. 26-28, 1980.
Kirby, I.J. et al "A Small Divergent Detonation Theory for Intermolecular Explosives", 8th Int. Symp. on Detonation, Office of Naval Research, Report NSWC MP 86-194; p. 176-186; Albuquerque, New Mexico, USA, Jul. 15-19, 1985.
Minchinton, A. et al "The application of computer modelling for blasting and flow in sublevel caving operations", Ninth Underground Operators' Conference; p. 65-73; Perth, Western Australia, Australia, Mar. 7-9, 2005.
Minchinton, A., et al "Fragmentation and heave modelling using a coupled discrete element gas flow code", Fragblast: International Journal for Blasting and Fragmentation, vol. 1, Issue 1, p. 41-57; (1997).
Onederra, et al "Modelling fracturing, disturbed and interaction zones around fully confined detonating charges", Mining Technology: Transactions of the Institutions of Mining and Metallurgy: Section A, vol. 122, Issue 1; p. 20-32; (2013).

(56) References Cited

OTHER PUBLICATIONS

Onederra, I.A., et al "Modelling blast induced damage from a fully coupled explosive charge", International Journal of Rock Mechanics &Mining Sciences, vol. 58; p. 73-84; (2013).
Orica Mining Services "Case Study: Controlling Coal Damage: Ensham Mine"; Online; p. 1 (2005).
Owen, D.R.J., et al "A finite element-discrete element approach to the simulation of rock blasting problems", Proc. 11th Symp. on finite elements in South Africa, Centre for Research in Computational and Applied Mechanics; p. 39-58; Cape Town, South Africa, Jan. 15-17, 1992.
Preece, D.S. et al, "Expanded Rock Blast Modelling Capabilities of DMC_BLAST, Including Buffer Blasting", Proc. 13th Annual Symposium on Explosives and Blasting Research International Society of Explosives Engineers; p. 1144-1153; Las Vegas, Nevada, USA, Feb. 2-5, 1997.
Ray, S. K., et al "Cast blasting—state of the art" Fragblast—Int. J. of Blasting ad Fragmentation, vol. 3; p. 291-302; (1999).
Sellers, E., et al "Field-scale modelling of blasting in Kimberlite using the Hybrid Stress Blasting Model", Proc. in the 38th Annual Conference on Explosives and Blasting Technique; p. 627-638; Nashville, Tennessee, USA; Feb. 12-15, 2012.
Sellers, E., et al "Improved Understanding of Explosive-Rock Interactions using the Hybrid Stress Blasting Model", The Southern African Institute of Mining and Metallurgy Southern Hemisphere International Rock Mechanics Symposium SHIRMS; p. 1-15; (2012).
Sheahan, R.M., et al "Non-Ideal Explosive Performance Prediction using the CPEX Model", The AustIMM Explosives in Mining Workshop; p. 17-21; Melbourne, Victoria, Australia; Nov. 1988.
Stefanizzi, S. et al "Numerical modelling of standard rock mechanics laboratory tests using a finite/discrete element approach" Proc. of the 3rd CANUS Rock Mechanics Symposium, Edited by Diederichs, M. et al; p. 1-8; Toronto, Canada; May 2009.
Vyazmensky, A., et al "Role of Rock Mass Fabric and Faulting in the Development of Block Caving Induced Surface Subsidence" Rock Mechanics and Rock Engineering, vol. 43, Issue 5; p. 533-556; Sep. 2010.
"Statutory Declaration of Geoffrey Brent", In the Matter of Australian Patent Application No. 2004293486 in the name of Orica Explosives Technology Pty Ltd. and In the Matter of Opposition thereto by Dyno Nobel Inc., 169 pages, Sep. 24, 2013.
"Statutory Declaration of Peter Dare-Brian", In the Matter of Australian Patent Application No. 2004293486 in the name of Orica Explosives Technology Pty Ltd. and In the Matter of Opposition thereto by Dyno Nobel Inc., 100 pages, Sep. 23, 2013.
"Statutory Declaration of Timothy Hagan", In the Matter of Australian Patent Application No. 2004293486 in the name of Orica Explosives Technology Pty Ltd. and In the Matter of Opposition thereto by Dyno Nobel Inc., 25 pages, Sep. 10, 2013.
"Statutory Declaration of Michael Humphreys", In the Matter of Australian Patent Application No. 2004293486 in the name of Orica Explosives Technology Pty Ltd. and In the Matter of Opposition thereto by Dyno Nobel Inc., 18 pages, Oct. 23, 2013.
"Statutory Declaration of Sarma Kanchibolta", In the Matter of Australian Patent Application No. 2004293486 in the name of Orica Explosives Technology Pty Ltd. and In the Matter of Opposition thereto by Dyno Nobel Inc., 8 pages, Nov. 25, 2013.
"Statutory Declaration of Peter Dare-Bryan", In the Matter of Australian Patent Application No. 2004293486 in the name of Orica Explosives Technology Pty Ltd. and In the Matter of Opposition thereto by Dyno Nobel Inc., 81 pages, Jan. 20, 2014.
"Statutory Declaration of Sarma Kanchibolta", In the Matter of Australian Patent Application No. 2004293486 in the name of Orica Explosives Technology Pty Ltd. and In the Matter of Opposition thereto by Dyno Nobel Inc., 12 pages, Apr. 24, 2014.
"Statutory Declaration of Michael Humphreys", In the Matter of Australian Patent Application No. 2004293486 in the name of Orica Explosives Technology Pty Ltd. and In the Matter of Opposition thereto by Dyno Nobel Inc., 10 pages, Apr. 17, 2014.
"Statutory Declaration of Sarma Kanchibolta", In the Matter of Australian Patent Application No. 2004293486 in the name of Orica Explosives Technology Pty Ltd. and In the Matter of Opposition thereto by Dyno Nobel Inc., 82 pages, Jun. 26, 2014.
"Statutory Declaration of Sarma Kanchibolta", In the Matter of Australian Patent Application No. 2004293486 in the name of Orica Explosives Technology Pty Ltd. and In the Matter of Opposition thereto by Dyno Nobel Inc., 56 pages, Jul. 28, 2014.
"Statutory Declaration of Sarma Kanchibolta", In the Matter of Australian Patent Application No. 2004293486 in the name of Orica Explosives Technology Pty Ltd. and In the Matter of Opposition thereto by Dyno Nobel Inc., 80 pages, Oct. 8, 2014.
"Statutory Declaration of Peter Dare-Bryan", In the Matter of Australian Patent Application No. 2004293486 in the name of Orica Explosives Technology Pty Ltd. and In the Matter of Opposition thereto by Dyno Nobel Inc., 92 pages, Jan. 20, 2015.
Gay, Rebekah, "Amended Statement of Grounds and Particulars", In the Matter of Australian Patent Application No. 2004293486 in the name of Orica Explosives Technology Pty Ltd. and In the Matter of Opposition thereto by Dyno Nobel Inc., 18 pages, Jan. 3, 2013.
Zammit, Michael, "Second Further Amended Statement of Grounds and Particulars", In the Matter of Australian Patent Application No. 2004293486 in the name of Orica Explosives Technology Pty Ltd. and In the Matter of Opposition thereto by Dyno Nobel Inc., 8 pages, Feb. 5, 2016.

* cited by examiner

METHOD OF BLASTING MULTIPLE LAYERS OR LEVELS OF ROCK

CROSS REFERENCE TO RELATED APPLICATIONS

This application is a divisional of and claims priority to U.S. application Ser. No. 10/596,066, filed on Apr. 12, 2007, which is a national phase application of PCT application PCT/AU2004/001401, filed on Oct. 13, 2004, which claims priority to Australian application 2003906600, filed on Nov. 28, 2003. The contents of the above applications are incorporated by reference.

The present invention relates to a method of blasting, and is particularly concerned with a method of blasting multiple layers or levels of rock within mining operations, including layers that comprise waste material and/or recoverable mineral such as coal seams.

Current practices in open cut coal operations generally involve separate drill and blast cycles for blasting separate layers of material, such as waste or "burden" (over- and inter-) and coal. Similar practices are sometimes followed in the recovery of metal ores and, where appropriate, the present invention will be described in terms of "recoverable mineral" encompassing both coal, metal ores and other recoverable material of value. In the case of metal ores, blasts may be conducted in layers whose thickness is often dictated by equipment requirements rather than mineralogical formations. However, the principles of blasting multiple layers as described herein may be equally applicable to that case.

Typically, layers of overburden are drilled and fired separately to the underlying recoverable mineral seam and/or subsequent interburden layer(s) and recoverable mineral seam(s). Particularly in coal operations, overburden blasts may be undertaken as throw blasts (also referred to as cast or movement blasts) to achieve productivity gains from moving some overburden to a final spoil position directly as a result of the blast. After complete excavation of the remaining overburden, the recoverable underlying mineral seam is drilled and blasted as a separate event, usually with quite different blast design parameters more suited to the recoverable mineral. In particular, the blasts in these layers are usually designed to minimise unwanted crushing, damage and displacement of the recoverable mineral. Similarly, the subsequent layers of interburden below the upper recoverable mineral seam(s), and further recoverable mineral seam(s) are usually also drilled and blasted in separate respective blast cycles.

A few operations undertake so-called "through-seam" blasting whereby overburden and underlying interburden are drilled and blasted in a single blast cycle, thus blasting through any intermediate seam or seams of recoverable mineral(s). These blasts are specifically designed to minimise lateral movement of all of the material in order to avoid any disruption of the seam or seams of recoverable mineral, except possibly in a vertical sense but always with the goal of minimising dilution with the waste material. Thus, explosive powder factors in through-seam blasts are generally low and blast initiation timing that promotes forward or sideways movement of the material, such as used in throw blasting, is not employed in through-seam blasting. In conventional through-seam blasting the delays between adjacent holes are designed to be the same for each layer blasted. Often through-seam blasting is used where the seam or seams of recoverable mineral are relatively thin, allowing the subsequent mining of such seams without the need to load explosives within the seam horizons in the blast field.

By way of example only, conventional through-seam or multi-layer blasting has been described in the following papers:

Burrell M. J., 1990. "Innovative Blasting Practice at Sands Hill Coal Company, Proceedings of the 16th Annual Conference on Explosives and Blasting Technique Orlando, Fla., USA, International Society of Explosives Engineers;

Chung S. H. and Jorgenson, G. K. 1985., "Computer Design and Field Application of Sub-Seam and Multi-Seam Blasts in Steeply Dipping Coal Seams", Proceedings of the Eleventh Conference on Explosives and Blasting Technique, San Diego, Calif., USA, International Society of Explosives Engineers; and Orica Explosives, 1998. Safe and Efficient Blasting in Surface Coal Mines, Chapter 10, pp156-159.

Typically, mines that employ through-seam blasting have situations of steeply dipping or undulating coal seams. Such situations do not favour conventional strip mining that employs throw blasting of the overburden since the overburden and coal do not occur in regular layers that can be blasted separately with conventional blast designs. The essence of through-seam blasting is to drill long blastholes through the various layers of overburden and coal. In this process, the identification of the location of the coal seams within blastholes is essential. Explosive charging of the blastholes is then conducted according to the location of the coal seams. Reduced or nil explosive charges are employed where the blastholes intersect the coal seams, in order to reduce damage and disruption of the coal seams.

Another paper, which describes an unconventional form of through-seam blasting, is Laybourne R. A., et al., "The Unique Combination of Drilling and Blasting Problems Faced by New Vaal Colliery, RSA", 95$^{th}$ Annual General Meeting, Petroleum Society of CIM, 1993, No. 93, CIM Montreal. According to this paper multi-deck blasting was introduced in deeper areas of a colliery to ensure noise and vibration levels were kept within design requirements, as well as to minimize overall blast ratios. The paper also describes through-seam blasting in areas of the mine where some of the coal has previously been extracted by underground mining, leaving pillars of coal inbetween. The paper suggests that, while coal contamination was anticipated to be a problem when blasting the pillars, in practice no serious problems were experienced and the technique proved to be very successful. Additionally, the paper notes that it was theorised that improved results and less coal contamination would occur using delays between pillar charges and the charges in the interburden, but that test work was conducted to investigate the theory with no real improvement being determined.

Korean Patent Application 2003009743 describes a method of blasting multiple layers of rock. Its purpose is to provide a more productive method for blasting a single rock mass while controlling vibration and other blasting environmental effects such as noise and flyrock, with the initiation direction being governed by the direction in which noise must be minimised. To achieve this, the rock mass is divided into multiple steps, with the length of the blastholes in the first step being determined by choosing a length appropriate to the minimum burden, the length of the blastholes of the second step being twice that of the first step, and the length of the blastholes of the third step being three times that of the first step. Equal blasthole spacings for each layer are proposed according to a very specific formula, and the order of initiation is specified as firstly the upper portion of the front row, then sequentially the lower portion of the front row, the upper portion of the next row, the lower portion of that row and so forth. The amount of explosives in each step may vary in order to achieve the same blasting effect in all of the blastholes.

It would be highly advantageous to provide a method of blasting that can increase overall mining productivity by allowing several layers of material to be blasted together within one drill, load and blast cycle in a more productive way than is currently provided by conventional blasting methods including through-seam blasting, and this is the aim of the present invention.

According to a first aspect of the present invention there is provided, in open cut mining for recoverable mineral, a method of blasting plural layers of material in a blast field including a first body of material comprising at least a first layer of material and a second body of material comprising at least a second layer of material over the first body of material, the blast field having at least one free face at the level of the second body of material, the method comprising drilling blastholes in the blast field through the second body of material and, for at least some of the blastholes, at least into the first body of material, loading the blastholes with explosives and then firing the explosives in the blastholes in a single cycle of drilling, loading and blasting at least the first and second bodies of material, wherein the first body of material is subjected to a stand-up blast in said single cycle and said second body of material is subjected to a throw blast in said single cycle whereby at least a substantial part of the second body of material is thrown clear of the blast field beyond the position of said at least one free face.

In the context of the present invention, unless otherwise stated or apparent, the term "layers" (and variations thereof such as layer) is intended to mean a predetermined region or zone within a blast field. In the case that the blast field comprises a geological formation of essentially the same material, a layer will correspond to a predetermined region within the material, the boundaries of the region being determined by the intended blast outcomes in the material. By way of example, in quarry blasting it may be desired to subject an upper region of material to a throw blast with another (underlying) region being subjected to a stand-up blast. In this case the layers are artificially conceived based on the intended blast outcome rather than corresponding to physically distinct strata of the material being blasted.

In the case that the blast field comprises plural strata of material of distinct characteristics, the layers will typically correspond to the strata since the blast outcomes associated with the present invention are then usually specific to each individual stratum. By way of example, the blast field may comprise a coal seam (stratum) extending beneath overburden. In this simple case the layers correspond respectively to the strata of coal and overburden. The first aspect of the invention will be described in more detail with reference to strata of material, but is not limited thereto.

In an embodiment of this first aspect, the method involves blasting plural strata of material including a first body of material comprising at least a first stratum of material and a second body of material comprising at least a stratum of overburden over the first body of material. The present invention therefore provides in this embodiment a method of blasting plural strata of material including a first body of material comprising at least a first stratum of material and a second body of material comprising at least a stratum of overburden over the first body of material in a blast field having at least one free face at the level of the second body of material, the method comprising drilling blastholes in the blast field through the second body of material and, for at least some of the blastholes, at least into the first body of material, loading the blastholes with explosives and then firing the explosives in the blastholes in a single cycle of drilling, loading and blasting at least the first and second bodies of material, wherein the first body of material is subjected to a stand-up blast in said single cycle and said second body of material is subjected to a throw blast in said single cycle whereby at least a substantial part of the second body of material is thrown clear of the blast field beyond the position of said at least one free face.

More generally, differential blast outcomes, specifically in the first aspect of the invention differential forward movement of the material, are achieved for different layers of material. In one embodiment, the first aspect of the invention involves the use of blasts that combine a throw blast design for overlying overburden with one or more stand-up designs for underlying interburden and/or recoverable mineral seams, in a single cycle of drilling, loading and blasting (sometimes referred to as a "single cycle" hereinafter). Hence, the entire selected mass of material to be blasted, including for example overburden, interburden and recoverable mineral may be drilled, loaded with explosives and initiators, and fired essentially as a single event.

To achieve suitable throw, the second body of material comprises a free face from which throw of material may take place. In this aspect of the invention, the free face extends at least partly, and preferably substantially, i.e. more than 50%, over the depth of the second body of material. In some situations it may be preferred that the free face does not extend into the first body of material since this may assist in protecting the first body of material against the effect of the throw blast of the second body of material. In this case a portion of the second body of material will overlie the first body of material in the direction of the intended throw associated with the throw blast. This portion of the second body of material may usefully buffer the first body of material thereby protecting it against any unwanted effect, such as stripping, that may otherwise occur as a consequence of the throw blast. Other possibilities for providing such buffering are described later.

Substantial productivity gains can be obtained by throw blasting the overburden where currently the overburden is blasted in a stand-up mode in conventional through-seam blasting. Any throw of overburden into the final spoil position obtained using the method of the invention translates into a corresponding direct increase in productivity. For the purposes of the present invention "at least a substantial part of the second body of material" means at least 10% of the second body of material. The preferred minimum amount thrown clear in a conservatively designed throw blast is preferably at least 15%, and more preferably at least 20%, and generally throw blasting can achieve a throw of 25% or more. Conversely, for the stand-up portion of the blast, very little, if any, of the first body of material is thrown clear of the blastfield.

Productivity gains are additionally achieved by the first aspect of the invention from the reduction in drill, load and blast cycles. This alleviates the need for separate blast clean up, drill hole surveying and drill rig set up, explosive loading and blast firing steps in the mining sequence. In particular, the need for dedicated drill rigs and dozing equipment normally used in the separate drill, load and blast cycles of the mineral seams is eliminated. Additionally, intermediate recoverable mineral seams that may have previously required separate blasting may not have to be blasted at all, instead being sufficiently broken by the underlying stand-up portion of the blast.

Furthermore, wall control may be facilitated by the first aspect of the invention, since highwalls do not have to be established prior to a separate recoverable mineral blast occurring. Since dedicated recoverable mineral blasts generally occur at the toes of such highwalls, they may damage the highwalls and lead to wall failure onto the recoverable mineral. Additionally, the faster access to the recoverable mineral achievable by the first aspect of the invention, since it now does not require a separate drill, load and blast cycle, will tend to reduce the likelihood of wall failures onto the recoverable mineral prior to its removal.

The second body of overlying material may consist essentially of a stratum of overburden, that is essentially only overburden, while the first body of material preferably comprises recoverable mineral in one or more strata, and interburden in the case of two or more strata of recoverable mineral. However, this is not essential, since the first aspect of the invention can be applied to other combinations of layers of material. Such cases may include several layers of overburden and interspersed layers of recoverable mineral. The differential blast designs and outcomes in such cases of multiple layers may be made up of various combinations and sequences of the general case for two layers as described herein. In one possible scenario, a third body of material, which may comprise one or more strata of burden and/or recoverable mineral, may lie between the first and second bodies. Such a third body of material may be subjected to, for example, a throw blast in said single cycle of different design and/or outcome to the second body of material. For instance, in the single cycle the third body of material might be thrown a greater or lesser distance than the second body of material. It is also conceivable that a further body of material, which might comprise a stratum of burden or recoverable mineral, overlies the second body of material and is subjected to a stand-up blast with the second body of material being subjected to a throw blast.

The differences in blast design in the single cycle in the bodies of material may be dictated by differences in rock properties, such as hardness, quality or whether it is recoverable mineral or not, as well as by the need to provide for a stand-up blast in at least the first body of material and a throw blast in at least the second body of material. Blast design features that may be varied for the bodies of material include blasthole pattern, explosive type, density, loading configuration, mass, powder factor, stemming, buffering of the first body of material and explosive initiation timing.

The blastholes in the blast field are usually disposed in plural rows extending substantially parallel to the at least one free face, and a primary parameter for achieving different outcomes in the different bodies of material in the blast field is different inter-hole and/or inter-row delays in the blasts in the different bodies. The different outcomes will be throw blasts versus stand-up blasts in a method according to the first aspect of the invention, but other differential outcomes may be desirable. Such other differential outcomes include fragmentation of the material. For example, it is often required to achieve fine fragmentation of overburden material to increase excavation productivity. By contrast, it is often required to achieve coarser fragmentation with more "lump" material in the recoverable mineral, particularly in the case of coal or iron ore. These requirements may be reversed for other minerals, for example in metalliferous or gold operations it may be desirable to achieve a finer fragmentation within the mineral layers than within the layers of waste material. This will increase the productivity of the downstream comminution processes of the ore.

Thus, according to a second aspect of the invention, there is provided, in open cut mining for recoverable mineral, a method of blasting plural layers of material in a blast field including a first body of material comprising at least a first layer of material and a second body of material comprising at least a second layer of material over the first body of material, the method comprising drilling rows of blastholes through the second body of material and, for at least some of the blastholes, at least into the first body of material, loading the blastholes with explosives and then firing the explosives in the blastholes in a single cycle of drilling, loading and blasting at least the first and second bodies of material, wherein the second body of material is subjected to a blast of different design including, for said at least some of the blastholes with a respective deck of explosives in each of the first and second bodies of material, at least different inter-row blast hole delay times between adjacent rows and/or different inter-hole blast hole delay times in any one row to that of the first body of material, resulting in a different blast outcome in the second body of material to that in the first body of material.

In this second aspect of the invention the term "layers" (and variations thereof) has the same intended meaning as described above in connection with the first aspect of the invention.

A reference to "inter-hole" herein is to the blastholes in any one row of blastholes. The distance between blastholes in any one row is known as the spacing. The distance between rows of blastholes is known as the burden, and the burden is generally less than the spacing. Usually, where the blastfield has a free face, the rows of blastholes will extend substantially parallel to the free face. The blastholes in any one row need not be exactly aligned but may be offset from each other or from adjacent blastholes in adjacent rows.

In one embodiment of this second aspect, the method involves blasting plural strata of material including a first body of material comprising at least of first stratum of material and a second body of material comprising at least a stratum of overburden over the first body of material. The present invention therefore provides in this embodiment a method of blasting plural strata of material including a first body of material comprising at least a first stratum of material and a second body of material comprising at least a stratum of overburden over the first body of material, the method comprising drilling rows of blastholes through the second body of material and, for at least some of the blastholes, at least into the first body of material, loading the blastholes with explosives and then firing the explosives in the blastholes in a single cycle of drilling, loading and blasting at least the first and second bodies of material, wherein the second body of material is subjected to a blast of different design including, for said at least some of the blastholes with a respective deck of explosives in each of the first and second bodies of material, different inter-row blasthole delay times between adjacent rows and/or different inter-hole blasthole delay times in any one row to that of the first body of material, resulting in a different blast outcome in the second body of material to that in the first body of material.

The second body of material may consist essentially of the stratum of overburden. In this case, in both the first and second aspect of the invention, the explosives in the second body of material are usually spaced from the bottom of the second body of material. As described with reference to the first aspect, in the second aspect of the invention a third body of material may be disposed between the first and second bodies of material, the third body of material comprising at least one stratum of burden and/or recoverable mineral, with the third body of material being subjected to a blast in said single cycle of different design to the blast to which the first and/or second bodies of material are subjected in said single cycle.

In the embodiment of blasting plural strata in either of the first and second aspects of the invention, the first body of material may comprise at least two strata of recoverable mineral and at least one stratum of interburden therebetween. In this case the explosives in the first body of material are usually disposed only in the at least one stratum of interburden. Also, the explosives in the interburden are generally spaced from the strata of recoverable mineral. In this embodiment the blastholes are typically not drilled into the lowermost strata of recoverable mineral in the first body of material. The explosives in each of at least some of the blastholes in the interburden may be provided as a main column of explosives and as a relatively small deck of explosives spaced from and beneath the main column. In this case the relatively small deck of explosives is usually fired on a different delay to the main column.

In either of the first and second aspects of the invention, not all of the blastholes in the second body of material need extend into the first body of material. Any blasthole that does not extend into the first body of material may, but need not, extend to the bottom of the second body of material and the phrase "through the second body of material" shall be construed accordingly.

In the second aspect of the invention, and depending upon the desired different blast outcomes between the bodies of material, the blast field may not have a free face, or may have a partial free face.

As noted above, the differential outcomes in the second aspect of the invention may comprise a throw blast in the second body of material and a stand-up blast in the first body of material and for convenience the second aspect of the invention will hereinafter be described with these differential outcomes in mind. In this case, to achieve throw of the second body of material, the second body of material has an associated free face in the intended throw direction. Other aspects of the first aspect of the invention described hereinbefore may also apply individually or in combination to the second aspect of the invention, and vice versa.

In another embodiment of either of the first and second aspects of the invention, the explosives in each of at least some of the blastholes in the second body of material may be provided as a main column of explosives and as a relatively small deck of explosives spaced from and beneath the main column. Here the relatively small deck of explosives generally is fired on a different delay to the main column.

The explosives in blastholes in the first body of material may be initiated from the back of the blast (remote from the location of the free face) towards the front of the blast (adjacent the location of the free face).

It is also possible that the explosives in blastholes in one or both of the first and second bodies of material may have an initiation point remote from edges of the blastfield. It is further possible that the blast in said one or both of the first and second bodies of material may proceed in multiple directions from said initiation points. It may also be appropriate in some circumstances to reverse the direction of firing, thus firing some strata from the back to the front (free face end) and some in the opposite direction. In the first body of material this may be done, for example, to improve buffering of that body, as discussed below.

In one embodiment of the first or second aspect the blast field has a free face at the level of the second body of material and the explosives in blastholes in the second body of material adjacent the back of the blast (remote from the location of the free face) are initiated before the explosives in blastholes in the second body of material further forward (closer to the location of the free face). This may be done to raise the final height of the muck pile at the back of the blast, so that there may be no substantial throw of this portion of the second body of material. This can make the dozing and/or dragline operations more efficient and increase productivity by reducing dragline pad production requirements.

In another embodiment of the first or second aspect, in said single cycle, for each blasthole with a respective deck of explosives in each body of material, the blast in the first body of material is initiated after initiation of the blast in the second body of material. The delay between initiation of the blast in the second body of material and initiation of the blast in the first body of material is typically about 40 seconds or less, preferably in the range of about 500 to 25000 ms. In an alternative embodiment of the first or second aspect, for each blasthole with a respective deck of explosives in each body of material, in said single cycle the blast in the first body of material is initiated before initiation of the blast in the second body of material.

In the first aspect of the invention, differential blast design features for achieving the throw blast in the second body of material and the stand-up blast in the first body of material may be selected from one or more of blasthole pattern, explosive type, explosive density, blasthole loading configuration, explosive mass, powder factor, stemming, buffering and explosive initiation timing.

Where the blastholes in the blastfield are disposed in plural rows extending substantially parallel to the at least one free face, for said at least some of the blastholes with a respective deck of explosives in each of the first and second bodies of material, the blast in the first body of material may have different inter-hole delays in any one row and/or different inter-row delays between adjacent rows to the blast in the second body of material.

In the second aspect of the invention, differential blast design features between the blast in the second body of material and the blast in the first body of material may be additionally selected from one or more of blasthole pattern, explosive type, explosive density, blast hole loading configuration, explosive mass, powder factor, stemming and buffering.

By way of example, where the blasting is for the recovery of coal and the second body of material is overburden, the following blast design parameters for throw and stand-up blasts, respectively, may apply:

The "throw-blast" design may have, but not be restricted to, powder factors in the range 0.1-1.5 kg/m$^3$ (mass of explosive per unit volume of rock—typically 0.4-1.5 kg/m$^3$), blasthole spacings and burdens in the range 2 m-20 m (typically 5 m-15 m), blasthole depths in the range 2 m-70 m and any explosive type, density or loading configurations used in normal blasting operations, such as ANFO blends, densities in the range 0.1-1.5 g/cm$^3$ and bulk pumped, augured, packaged or cartridged explosives. The inter-hole delays may be in the range 0-40000 ms, preferably, 0-100 ms, more preferably 0-45 ms and typically 1-30 ms, and the inter-row delays may be in the range of 0-40000 ms, preferably 0-2000 ms and typically 30-500 ms. The "throw-blast" portion of the blastholes will generally fire before the "stand-up" portion of the blastholes, with a separation in time in the range of 0-40000 ms, preferably 0-30000 ms, more preferably 100-25000 ms and typically 500-5000 ms. The "throw-blast" design will preferably have a complete or partial free face and substantially open void in front to allow the material to be thrown into the void.

The "stand-up" blast design may have, but not be restricted to, powder factors in the range 0.02-1.5 kg/m$^3$ (mass of explosive per unit volume of rock—but typically in the range 0.05-0.8 kg/m$^3$ and sometimes restricted to 0.05-0.4 kg/m$^3$), blasthole spacings and burdens in the range 2 m-20 m (typically 3-15 m), blasthole depths in the range 2 m-70 m and any explosive type, density or loading configurations used in normal blasting operations as mentioned above for the throwblast. The inter-hole delays may be in the range 0-40000 ms, preferably 0-1000 ms, more preferably 0-200 ms and typically 10-100 ms, and the inter-row delays may be in the range 0-40000 ms, preferably 0-2000 ms, more preferably 10-400 ms, and typically 20-200 ms.

While a maximum delay of 40 seconds has been identified between the blasts in the first and second bodies in the single cycle (for each blasthole with a respective deck of explosives in each body of material), this is generally only limited by the available initiator technology and may be even longer than this, effectively without limit, in accordance with the invention. For example, the delay may be several minutes, hours or days.

In one embodiment of the above example, a higher powder factor and explosive loading in the second body of material, to be subjected to the throw blast, may be in the range 0.3 to 1 kg, preferably 0.4 to 1 kg explosive per m$^3$ rock, as against 0.01 to 0.8 kg, preferably 0.01-0.5 kg explosive per m$^3$ rock in the first body of material, to be subjected to the stand-up blast. The blasthole pattern in the blast field may have more blastholes in the second body of material than in the first body of material. Thus, some of the blastholes in the second body of material may not extend into the first body of material, or even to the bottom of the second body of material. The first body of material may have more inert decks, whether by way of stemming or air decks, and/or lower energy/density explosive than the second body of material. Inter-hole blast delays may be shorter (typically 0-3 ms per m spacing) in the second body of material than in the first body of material (typically >3 ms per m spacing) and inter-row delays may be greater (for example, >5 ms per m burden, typically >10 ms/m) in the second body of material than in the first body of material (typically <10 ms/m burden). The delay between the throw blast in the second body of material and the stand-up blast in the first body of material may be as discussed above. In another timing variation, the initiation within explosives columns in each body of material may differ by utilising multiple primers within columns in both bodies of material with different inter-primer delay time in each body, or by utilising multiple primers in a column in only one of the bodies, with the explosives in the body having only one primer in each column. Primers may also be situated in different points of the column, ie near the top, centre or bottom of the explosives column to achieve different outcomes, such as swell and fragmentation.

Thus, in a preferred embodiment of the first aspect of the invention and in accordance with the second aspect of the invention, for said at least some of the blastholes with a respective deck of explosives in each of the first and second bodies of material, the first body of material may incorporate different inter-hole and inter-row (between adjacent rows) blasthole timing to the second body of material. The first body of material may also fire, with this different inter-hole and inter-row blasthole timing, a substantial time later than the second body of material, for example of the order of hundreds of milliseconds or even more than 10 seconds, thus allowing the second body of material to move laterally (in a throw blast) before the first body of material is fired. However, it may in some cases be desired to fire the first body of material before the second body of material, particularly if it is desired to use the second body of material to buffer at least part of the blast in the first body of material in a vertical direction.

In the first aspect of the present invention, and in the second aspect if the second body of material is subjected to a throw blast, the first body of material may be buffered in the direction of throw defined by the throw blast of the second body of material, as described herein. The buffering may be at least partly provided by material from the second body of material thrown in a throw blast in said single cycle. In this embodiment, the portion of the second body of material designed to provide the buffering material for the first body of material is usually adjacent at least one free face and is divided into layers by respective decks of explosives in the blastholes in said portion of the second body of material, and all the decks of explosives in any one layer of said portion are fired before any deck in a layer of said portion beneath said one layer.

It may be advantageous to provide some buffering material at the level of and over the first body of material, particularly where the first body is to be subjected to a stand-up blast in accordance with the first aspect of the invention. The intention is that the buffering material protects the first body of material from the effect of the throw blast of the second body of material. In this way the buffering material may be used to minimise or prevent stripping of material from the first body of material as a result of throw blasting of the second body of material.

The buffering material may comprise previously blasted or imported material that is positioned as required prior to blasting in accordance with the present invention. In this case the buffering material may be brought to a blast site by truck and positioned using any suitable (earth moving) equipment. Alternatively, as discussed above, the buffering material at least partly comprises material thrown from the second body of material in a throw blast in said single cycle. In this embodiment, the method of the invention may include initially blasting, as part of the single cycle, a front portion of the second body of material adjacent the free face thereof such that material falls in front of and over the first body of material to provide the buffer. This front portion may have a blast design (eg. powder factor, loading and/or timing) that does not throw it too far, but just permits it to fall down from the free face and lie in a suitable position in front of and over the first body of material. The main throw blast of the second body of material may then follow the initial blast after some delay. Such a delay may be as great as or, for example, substantially more than 1 second.

When the front portion of the second body of material is used to provide buffering material, the front portion may not be drilled to the full depth of the second body. Alternatively, the front portion may be divided into layers by respective decks of explosives in the blastholes in said portion of the second body of material, and all the decks of explosives in any one layer of said portions may be fired before any deck in a layer of said portion beneath said one layer.

As noted above, it may be advantageous to initiate the explosives in blastholes in the first body of material from the back of the blast (remote from the location of the free face) towards the front of the blast (adjacent the location of the free face) when the second body of material is being used to provide buffering for the first body. In one embodiment, the throw blast of the second body may be fired conventionally and the interburden of the first body may be fired soon after the last hole of the throw blast, being initiated from the back of the blast towards the front. The initiation timing of the interburden blast of the first body is selected so that the first rows are fired while the throw material above is still airborne, and the rows at the front of the blast are fired after buffering material from the throw blast has collected in front of the blast. This allows vertical relief of the interburden blast of the first body to improve the diggability of the interburden while maintaining controlled horizontal movement of the stand-up blast. The controlled movement and placement of material from the second body allows blasting of the economic mineral while maintaining stringent control over its movement, resulting in low losses and dilution.

Where the movement or breakage of a recoverable mineral seam is required to be kept to a minimum and the seam is located adjacent to one or more other strata (such as waste material) that are required to be substantially broken or moved by the blast, explosive loading in, above and/or below the recoverable mineral seam should be substantially reduced or avoided altogether through the use of inert stemming material or air decks. Thus, some blastholes may be loaded with explosives in particular horizons and only lightly loaded, or left completely uncharged, in other horizons. It may also be appropriate to drill different blasthole patterns in the different horizons, whereby higher powder factors may be achieved in specific horizons by drilling more holes into that horizon, and vice versa, as discussed above. In a situation where there are two or more strata of recoverable mineral, the blastholes, or some of them, may not be drilled into the lowermost stratum of recoverable mineral. Other techniques for reducing damage to mineral seams may be advantageously used within this invention. These may include the use of lower density explosives, and/or products with lower energy in or near the mineral. Other techniques may also be used, such as "baby decking", wherein the explosives in each of at least some of the blastholes in the second body of material are provided as a main column of explosives and a relatively small deck of explosives spaced from and beneath the main column. Preferably, the small deck of explosives is located just above the mineral and is fired on a separate delay from the main column of explosive in the burden.

In particular embodiments of the practice of the method of the invention in the manner described in the immediately preceding paragraph, any one or more of the following features may be provided:

- the explosives in the second body of material are spaced from the bottom of the second body of material;
- where the first body of material comprises two strata of recoverable mineral and at least one stratum of interburden therebetween, the explosives in the first body of material are disposed only in the at least one stratum of interburden;
- the explosives in the interburden may be spaced from the strata of recoverable mineral;
- the blastholes may not be drilled into the lowermost strata of recoverable mineral in the first body of material;
- the explosives in each of at least some of the blastholes in the interburden may be provided as a main column of explosives and a relatively small deck of explosives spaced from and beneath the main column;
- the relatively small deck of explosives may be fired on a different delay to the main column.

Advantageously, the loading and blasting in the single cycle in accordance with either aspect of the invention are preceded by blasthole logging to determine the location of any stratum of recoverable mineral in each blasthole. The accurate location of mineral strata and hence of appropriate explosives and or inert decking columns may be facilitated through the use of blasthole logging techniques, including techniques such as gamma-ray logging. Preferably three dimensional geometrical models of rocks and mineral strata are constructed from the logging and may be used in conjunction with blast computer models to optimise explosives loading configurations.

Advantageously, an electronic delay detonator system that preferably provides the features of a total burning front, delay accuracy and flexibility is used in the method of the invention. Electronic detonators, with accurately programmable delays, will greatly facilitate the desired inter-row and/or inter-hole blasthole delay times in accordance with the second aspect of the invention. Suitable electronic detonators for use in the present invention include the I-kon™ (Orica) detonators. The electronic detonators may be wired or wireless. The use of wireless detonators may allow very extended delays between the blasts in the first and second bodies, and/or between strata within the bodies as described above, but always within the single cycle of drilling, loading and blasting.

However, the method of the invention could be achieved with pyrotechnic delay detonators, either non-electrically-initiated shock tube pyrotechnic delay detonators or electrically-initiated pyrotechnic delay detonators. Two modes of pyrotechnic detonator initiation tie-up, described below by way of example, may be employed to achieve either the first or second aspects of the invention.

The first mode of non-electronic detonation comprises the use of pyrotechnic downhole delays in the first body of material that are longer than those used in the second body of material, while using a single set of surface initiators as in conventional practice. This would provide separation in time of the blasts in the two bodies but with each blast in each body essentially having the same nominal inter-hole and inter-row delay. The throw blast/s in the second body of material would be achieved through appropriate design parameters, including powder factor/s and the use of substantially free faces to enable a significant proportion of the blasted material to be thrown into the void space in front of the blast. Conversely, the stand-up blast/s in the first body of material would be achieved through appropriate design parameters, including powder factor/s and the presence of buffering, for example by material from the upper layers.

The second mode of non-electronic detonation comprises the use of downhole pyrotechnic delays in the first body of material that are longer than those used in the second body of material, in addition to using multiple sets of surface initiators, with each set of surface intiators connected to the downhole delays in the corresponding blast stratum. This would provide separation in time of the blasts in the separate bodies and would provide different inter-hole and inter-row delays in each blast layer, thus achieving the second aspect of the invention. As for the first mode, the throw blast/s would be facilitated by free faces while the stand-up blasts may be facilitated by buffering material, for example from the second body.

The applicant's International Patent Application No. WO 02/057707 published on 25 Jul. 2002 (and the corresponding U.S. National Phase application Ser. No. 10/469,093) discloses preferred criteria for a throw blast using electronic detonators, and its full disclosure is incorporated herein by reference. That patent application describes blast design parameters suitable for throw blasting as well as for blasts that require restriction of forward movement of the muckpile. Methods disclosed in that patent application may be applied in the first aspect of the invention in throw blast and/or stand-up blast designs and in the second aspect of the invention for various blast designs as required.

Various embodiments of a method of blasting in accordance with the present invention will now be described by way of example only, with reference to the accompanying drawings, in which.

Figure 5:
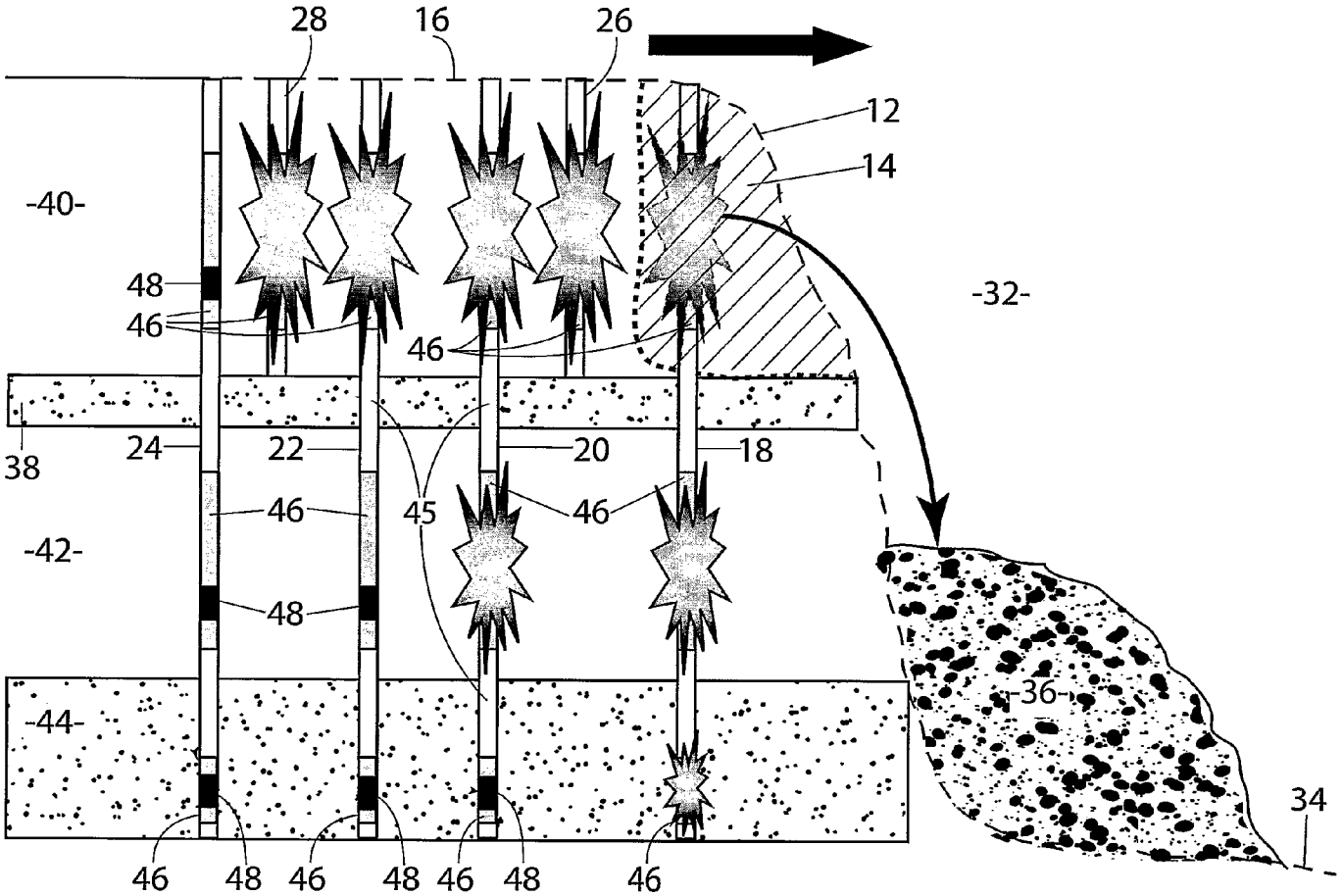
FIG. 5 illustrates a fourth particular embodiment of the method of the invention.
Figure 6A:
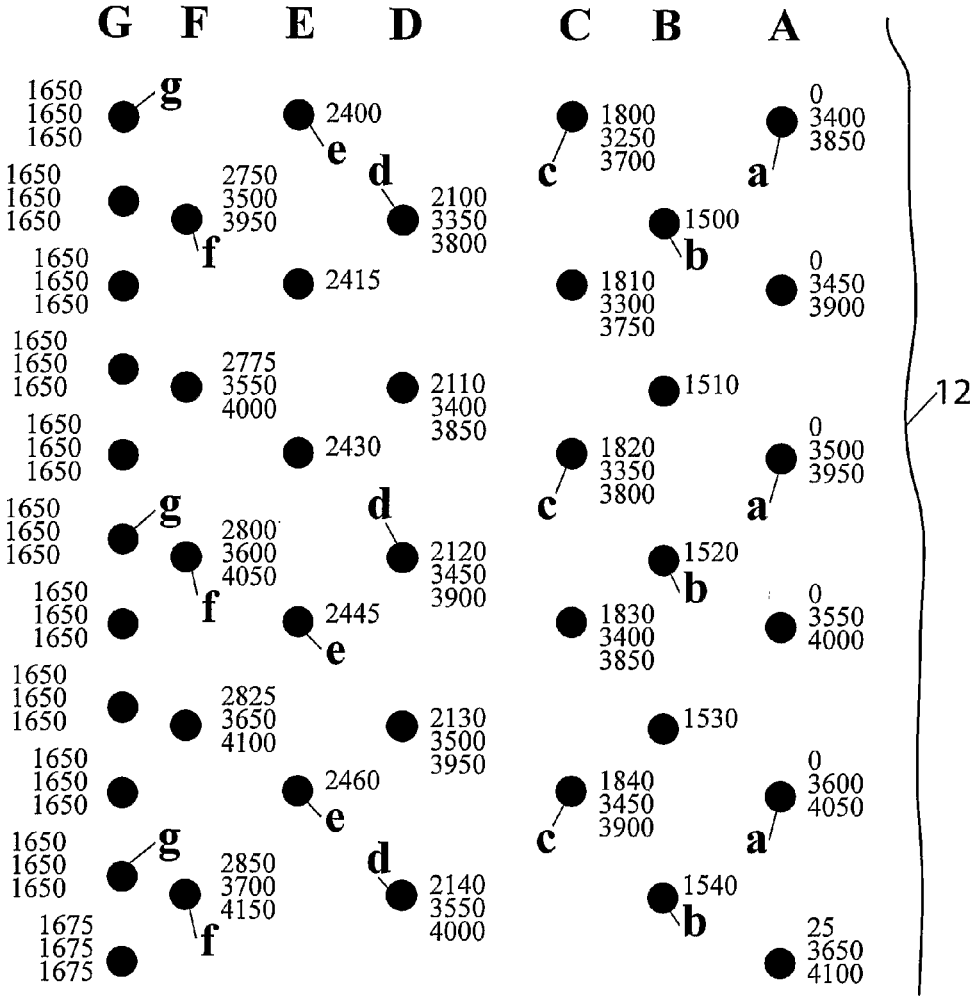
Figure 6B:
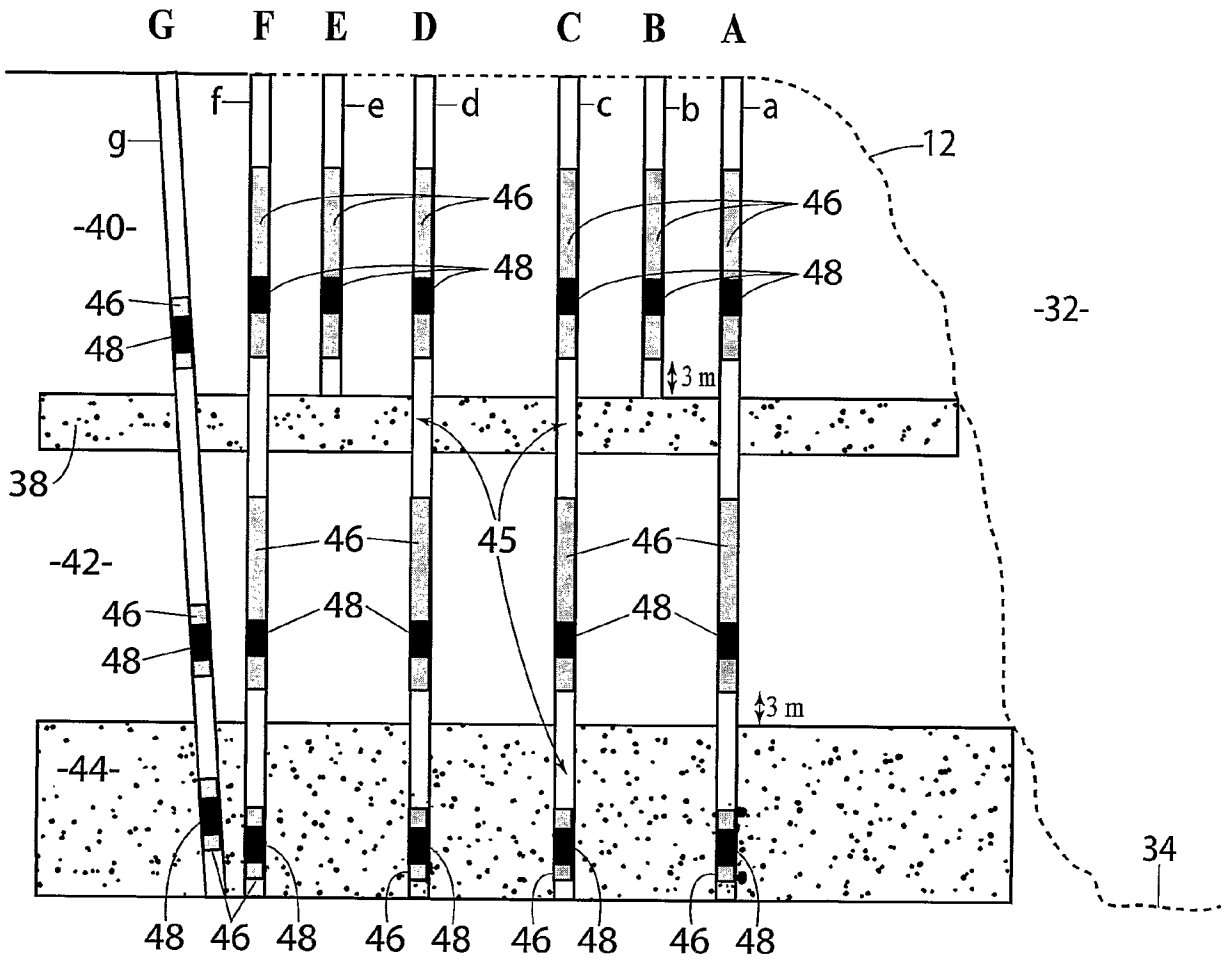
Figure 7:
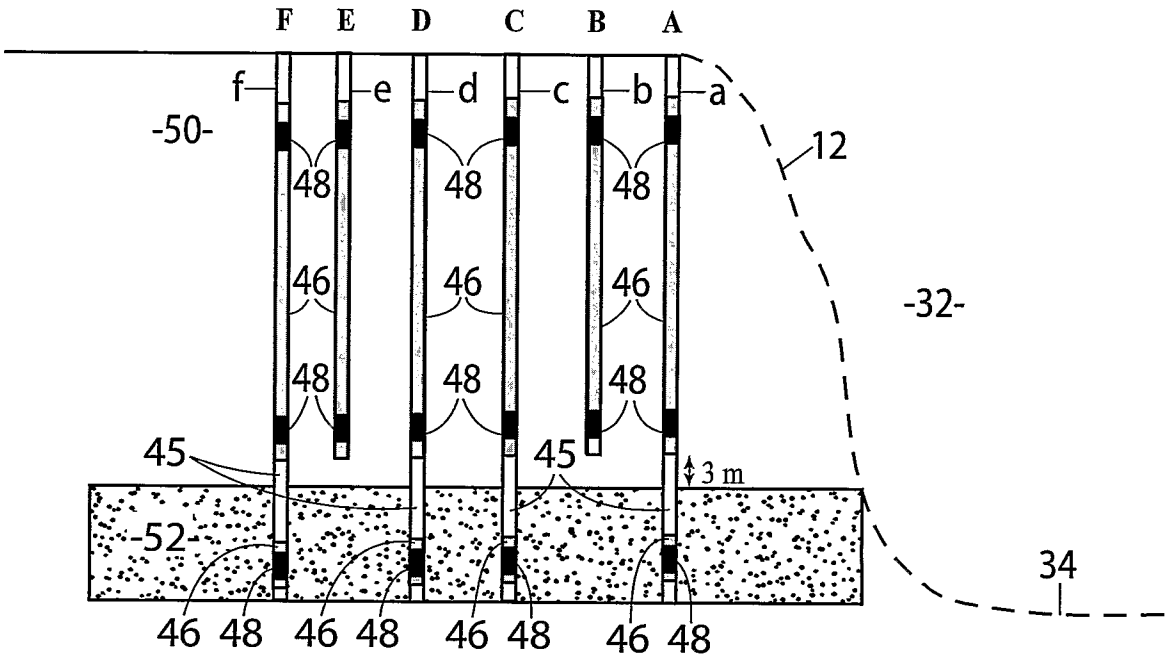
Figure 8:
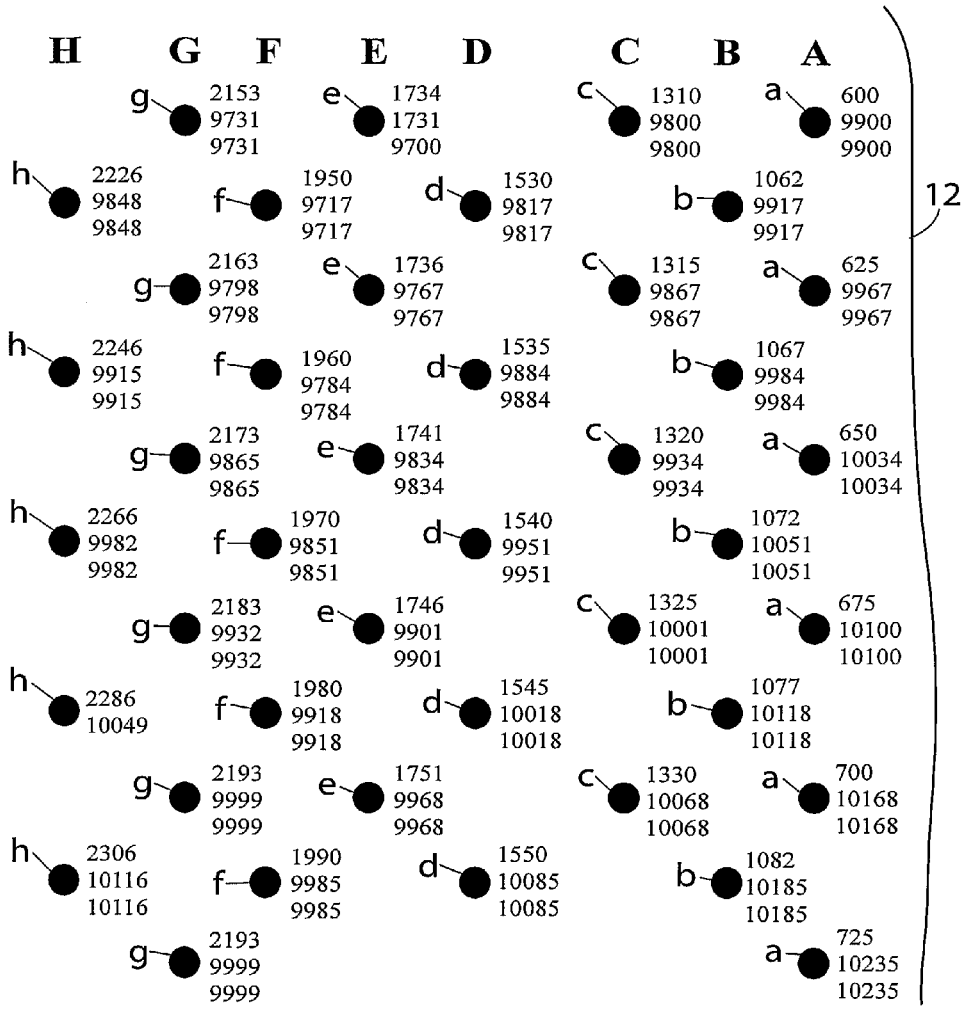

FIGS. 6*a* and 6*b* are plan and cross-sectional views, respectively, of a blast as described in the Example, which is in accordance with the embodiment of FIG. 5; and FIG. 7 illustrates a blast in accordance with the invention which achieves a differential fragmentation outcome; and FIG. 8 is a plan view similar to FIG. 6*a*, but of another blast in accordance with the invention.

Figure 1:
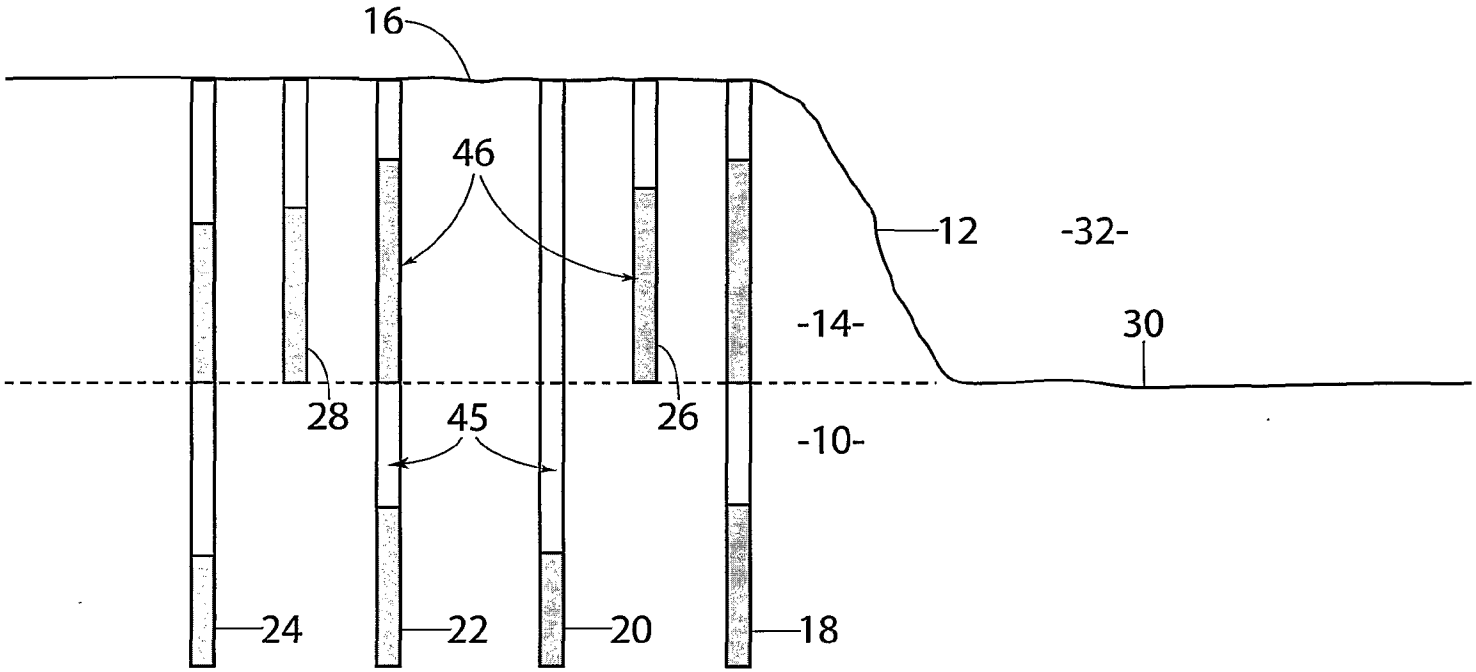
FIG. 1 illustrates a generalised concept of the method of the invention.

FIG. 1 illustrates a generalised concept for blasting two or more layers of material in accordance with the first invention. A first body 10 of material is shown as extending beyond a free face 12 of a second body of material 14. However, as in the embodiments of FIGS. 2 to 4, the free face 12 may extend to the bottom of the first body 10.

Figure 2:
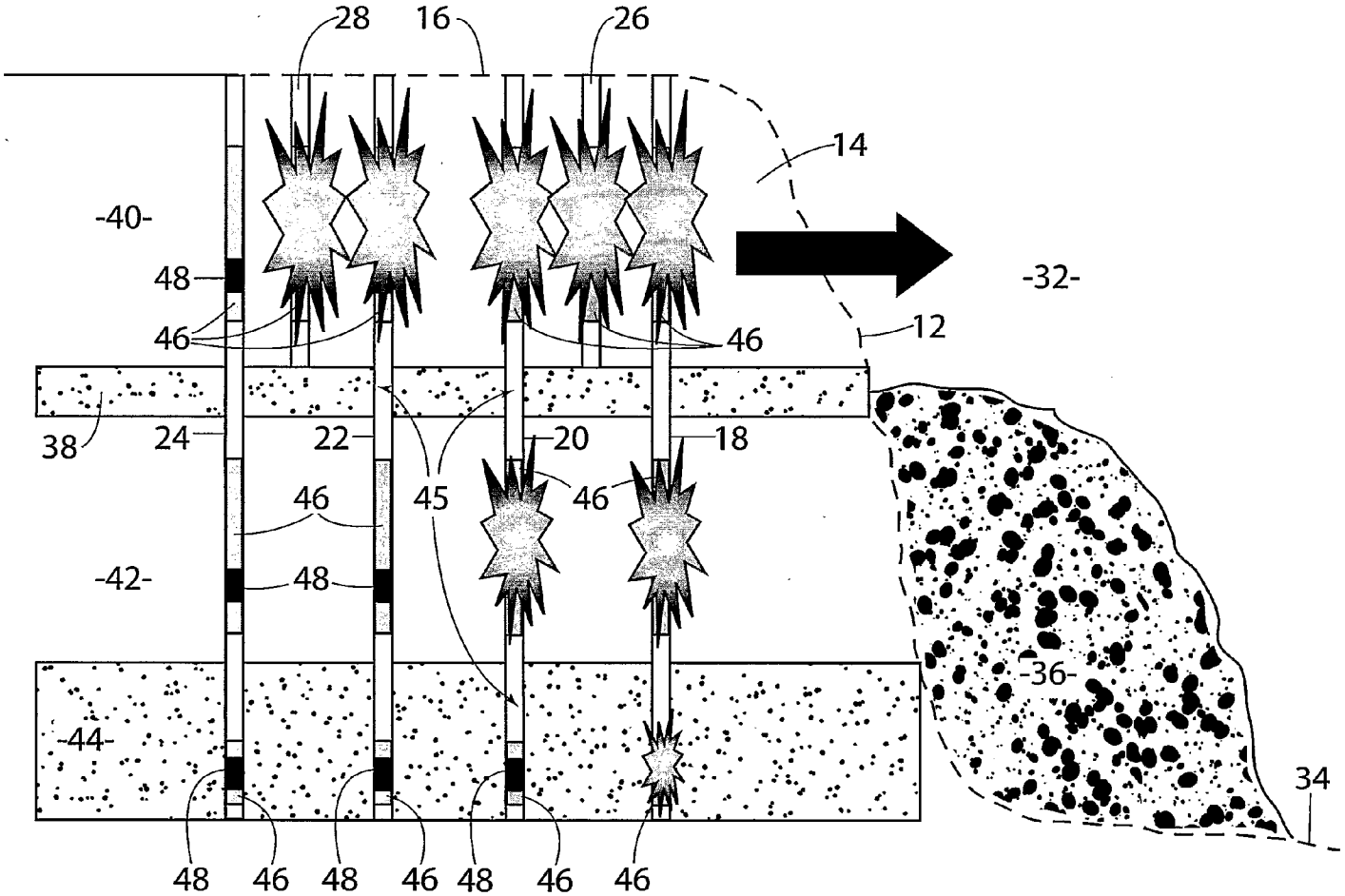
FIG. 2 illustrates a first particular embodiment of the method of the invention.
Figure 3:
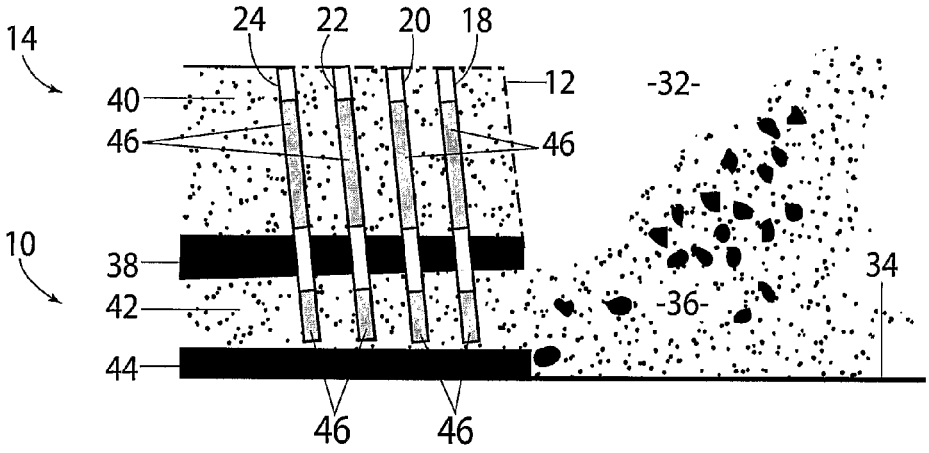
FIG. 3 illustrates a second particular embodiment of the method of the invention.
Figure 4:
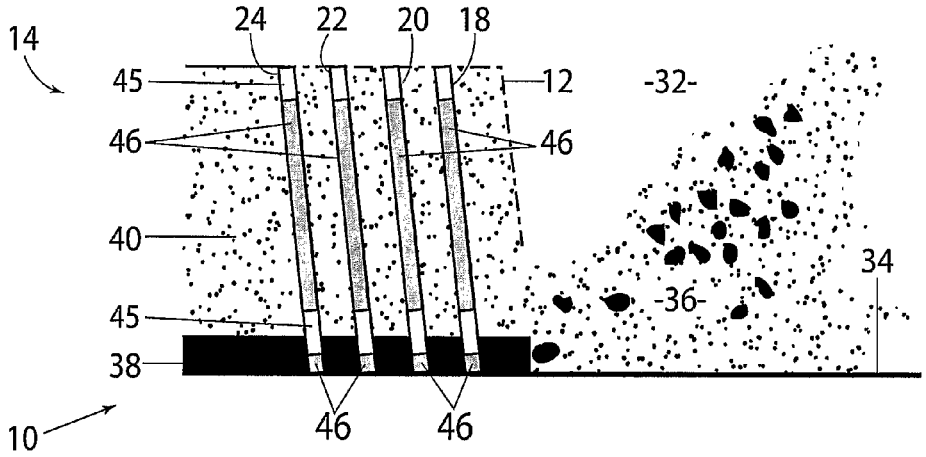
FIG. 4 illustrates a third particular embodiment of the method of the invention.

In the embodiment shown the first and second bodies 10, 14 of material may be of the same or different material. Thus, the second body of material may comprise burden or recoverable mineral (e.g. coal, ore), and the first body of material may comprise burden or recoverable mineral (e.g. coal, ore). Similarly, the first and second bodies of material may comprise materials having the same or different characteristics. For example, the first and second bodies of material may comprise predetermined regions of the same geological formation, or regions within a formation that have different geological characteristics e.g. hardness. Generally, but not necessarily, the second body 14 will be of one or more strata of overburden, while the first body 10 will have a stratum of recoverable mineral immediately (such as coal) below the second body 14, for example as illustrated in FIG. 4. However, at least a second stratum of recoverable material may be disposed as the lowermost stratum of the first body 10 with interburden between the or each two adjacent strata of recoverable mineral, as shown in FIGS. 2 and 3.

Returning to FIG. 1, the blastfield 16 is shown as having six rows of blastholes, but any number and arrangement of blastholes may be provided in order to give the desired differential outcomes of blasts, in this case a throw blast of the second body 14 of material and a stand-up blast in the first body 10 of material. The blastholes are shown as vertical, but those in any one row may be inclined, for example by up to about 30°, or even 40°.

As shown in this example, only some of the rows of blastholes, 18, 20, 22 and 24 along the blastfield 16 extend downwardly through both bodies 10 and 14 of material. The rows of blastholes 18, 20, 22 and 24 are approximately equally spaced, with the row 18 being the front row closest to the free face 12. Spaced between rows of the blastholes 18, 20, 22 and 24, in this case rows 18, 20 and 22, 24, may be further rows of blastholes 26 and 28, respectively, that extend downwardly only through the second body 14 of material. Such designs allow for more blastholes in one body of material, in this case the second body 14 of material. Higher explosive powder factors, for example to increase forward displacement of the second body of material 14, may be achieved differentially in the layers in this way.

Two decks of explosives material 46, one in each of the first and second bodies 10 and 14 of material, are shown in each of the blastholes 18, 22 and 24. However, in this generalisation, only one deck of explosives, in the first body 10, is shown in blasthole 20. Each of the shallower blastholes 26 and 28 also contains explosives material 46, with stemming material or air decks 45 being provided between the two decks of explosives in the boreholes 18, 22 and 24, and stemming material being provided above the explosives in all of the blastholes. Each or any of the blasthole pattern, the explosive type, density and loading, the powder factor and the initiating timing in the two bodies of material may be varied to provide the throw blast of the second body 14 of material and the stand-up blast in the first body 10 of material. Additionally, the buffering provided by the continuity of the first body 10 of material forwardly of the free face 12 would be taken into consideration in designing the stand-up blast in the first body 10.

The throw blast should be designed to throw at least 10% of the material of the second body 14 forwardly onto the floor 30 of the void 32 in front of the free face 12. More preferably, at least 15 to 30% or even more of the second body 14 of material is thrown forwardly onto the floor 30 by the throw blast. The more material that is thrown forwardly onto the floor 30, especially beyond a position of final spoil of waste material the less mechanical excavation and clearance of the material in the second body 14 needs to be performed to expose the first body 10.

The stand-up blast in the first body 10 is designed to break up the first body, usually within several seconds after the throw blast in the second body, but without throwing the material of the first body forwardly. Thus, any strata of recoverable mineral in the first body of material will be broken up but not substantially displaced. Thus, once the blasted second body of material has been cleared from the blast field, the exposed first body 10 may be excavated immediately in the same mining cycle.

FIG. 2 illustrates a specific embodiment of the generalised concept of FIG. 1, with the same arrangement of rows of blastholes, and for convenience only the same reference numerals will be used as in FIG. 1 where appropriate. Here there are four layers of material: a bottom coal seam 44 that is blasted with a stand-up blast design, an interburden layer 42 that is also blasted with a (different) stand-up blast design, a thin upper coal seam 38 that is sufficiently thin not to require any blasting and an uppermost overburden layer 40 that is blasted with a throw blast design. Another major difference in FIG. 2 is that the material of all of the layers of material ahead of the face 12 has been previously blasted and excavated so that the floor 34 of the void 32 in front of the face is at the level of the bottom of the first body 10 of material. Some previously blasted material on the floor 34 has been pushed into a pile 36 against the face 12 up to the level of the upper coal seam 38, to act as a buffer for the coal seams 38 and 44 and interburden 42 and enhance the stand-up blasts in those seams. It is equally possible for the top level of the pile 36 to extend just above the top level of the coal seam 38.

Decks 46 of explosives material are provided in each of the strata 40, 42 and 44, but not in the thin stratum 38 of coal. These decks would generally comprise different quantities and possibly types of explosive to provide different powder factors within each stratum. An electronic delay detonator 48, shown schematically, is provided in each of the decks 46 of explosives, and air decks or inert stemming (45) are provided between and above the decks of explosives in each blasthole.

In this example, the detonators 48 in the decks 46 in the stratum 40 of overburden of the second body 14 are initiated first, in order from the front row of blastholes 18 rearwards. The blasthole pattern, explosive type, density and/or loading, the powder factor and/or the initiation timing in the stratum 40 are designed with the intent of throwing as much of the blast material from the stratum 40 as possible in the circumstances forwardly of the free face 12 onto the floor 34 of the void, especially beyond a final spoil position on the floor such that mechanical excavation of such thrown material is not required.

In the same blasting cycle and within seconds of the throw blast of the overburden, the explosive material in the strata 42 and 44 is initiated, with the blasthole pattern, explosive type, density and/or loading, the powder factor and/or the initiating timing being designed to create a stand-up blast in which the material of the three strata 38, 42 and 44 is broken up but otherwise minimally displaced or thrown forwardly. The stand-up blast in the stratum 42 may occur before, after or at the same time as the stand-up blast in the stratum 44, and in each of these strata the initiation may be from the front row of blastholes 18 rearwards, the opposite, all at the same time or otherwise.

Once the blast in the first and second layers 10 and 14 has been completed, the residual overburden from the second body 14 may be excavated, followed by the coal in the stratum 38, the interburden from the stratum 42 and, lastly, the coal from the stratum 44, all in the same mining cycle.

Turning now to FIG. 3, the arrangement is very similar to that in FIG. 2 and, again, for convenience only the same reference numerals will be used, as they will in FIG. 4. Once again, the layers of the blast field consist of a stratum 40 of overburden, two strata 38 and 44 of coal and a stratum 42 of interburden. A buffer 36 of previously blasted material lies up against the free face 12 up to about the level of the top of the upper coal seam 38.

In this instance, only the four rows of through blastholes 18, 20, 22 and 24 are provided, and these are inclined with the toe towards the floor 34 and do not extend into the stratum 44 of coal. Thus, no explosives material is provided in the strata 38 and 44. Otherwise, the arrangement of decks 46 of explosives and electronic delays detonators (not shown) is similar to that in FIG. 2.

Once again, the explosive type, density and/or loading, the powder factor and/or the initiation timing in the two strata of burden are designed to create a stand-up blast in the lower interburden stratum with minimal displacement or lateral movement of the coal seams and a throw blast of as much of the overburden 40 as possible in the circumstances. The design is also such that the coal in the stratum 44 is broken up, but not otherwise substantially displaced, by the blast at the toe of the blastholes in the interburden stratum 42.

In FIG. 4, there is only a single stratum 38 of coal beneath the overburden 40, and in this instance decks 46 of explosives material are provided in the rows of blastholes 18, 20, 22 and 24 in the stratum 38, designed to break up the coal, but not otherwise displace it or dilute it with overburden material, in a stand-up blast. Again, the blast from the deck 46 of explosives in the stratum 40 of overburden is designed to throw as much as possible of the overburden on to the waste pile 36, which acts as a buffer for the first body 10.

FIG. 5 illustrates a variation of the blasting methodology illustrated in FIG. 2. For convenience the same reference numerals will be used as in FIG. 2 where appropriate. In the situation shown in FIG. 5 the front row of the overburden blast is fired first, some considerable time (of the order of seconds) earlier than the ensuing throw blast in the rest of the overburden material 40. This delay and the initiation timing of the entire blast are again provided an by electronic detonator system. The blastholes in the front row need not be drilled to the full depth of the overburden layer 40 but may instead only be drilled to a proportion of this depth. Alternatively, while FIG. 5 shows this front row of blastholes to extending downwards into the lower strata 42, this is not necessary. Such holes may be confined to the overburden layer 40, and then need not extend to its full depth. This portion of the blast is designed with a low powder factor and an appropriate delay timing so as to ensure that the broken material falls directly in front of at least some of the underlying strata of the first body of material 42 to be subjected to stand-up blasts. In this way, this material automatically provides buffering material 36 without the need to mechanically place such material in front of the blast block prior to the single cycle of drilling, loading and blasting all of the blastholes. The ensuing throw blast and subsequent stand up blasts follow as described earlier herein. This technique may also be applied to blasts where the blastholes do not extend into the lowermost stratum (as in conventional throw blasts where the underlying coal seam is not blasted in the same blast cycle but it is still necessary to provide buffer material in front of the coal to restrict any displacement that may occur during the throw blast of the overburden material).

A typical example of the generic multilayer blast as shown in FIG. 5 is given here and is illustrated in FIGS. 6*a* and 6*b*. For convenience the same reference numerals will be used as in FIG. 2 where appropriate. FIG. 6*a* shows a series of individual blastholes (a, b, c, d, e, f) arranged in rows A-F. Not all blastholes are labelled but it will be appreciated that all blastholes in the same row are identified by the same letter in the figure. Thus, row A comprises 6 blastholes denoted a. In FIG. 6*a* the numbering adjacent each blasthole is representative of the number of detonators in the blast hole and of the detonator delays (in ms) reading from top to bottom. For example, each blasthole a in row A has 3 detonators in it whereas each blasthole b in row B has only 1 detonator in it (this is shown more clearly in FIG. 6*b*). The blast illustrated in FIGS. 6*a* and 6*b* incorporates, all within the same cycle of drilling, loading and blasting the blastholes, an initial small buffering blast (in row A) and a subsequent throw blast within an upper overburden layer 40, an underlying coal seam that is not specifically blasted, an underlying interburden layer 42 that is blasted with a stand-up blast design and an underlying coal seam that is subsequently blasted in the same cycle with a different stand-up blast design (in rows B-F). In addition, this single cycle has a conventional "presplit" or "mid-split" row behind the back row of main blastholes (not shown in FIG. 5). This presplit row G is very lightly charged and employs very short or zero inter-hole and inter-deck delays in order to form a crack network between holes that defines the new highwall for subsequent blasts. It may be timed to fire either before or during the throw blast portion of the multilayer blast. All the aforementioned blasts within layers take place within a total time period of several seconds. While this example shows all these various blast types within the single cycle, it is an example for demonstration purposes and any one or some of these component blasts is optional (for example, the buffering blast or presplit may be omitted, with corresponding adjustments made to the hole initiation times following the principles employed in the various blast sections in this example).

In this example, the depths of the strata are as follows:

Stratum 1 (upper overburden layer): 20 m

Stratum 2 (underlying coal seam): 4 m

Stratum 3 (underlying interburden layer): 15 m

Stratum 4 (underlying coal seam): 10 m

In this example, there are additional rows, namely rows B and E in the uppermost (throw) layer of the blast as compared to the lower (stand-up) layers. This provides a higher overall powder factor and more extensive distribution of explosives within this layer, promoting forward movement of this layer of the blast.

The blast pattern employed here is a nominal burden distance (between rows and between the front row and free face) of 7 m and a nominal spacing distance (between holes within rows parallel to the free face) of 9 m. The blastholes (a-g) have a nominal diameter of 270 mm. The inter-row burden and the inter-hole spacings may vary from the front to the back of the blast. In this example, the inter-row burden between rows C and D is different, 8 m. The "stand-off" or separation distance between the back row of blastholes, row F, and the presplit row is 3 m at the collar. In this example, the presplit holes in row G are inclined slightly while the other blastholes are vertical. Blasthole angle may change throughout the blast pattern as required. The inter-hole spacing between holes in the presplit row (row G) is 4 m. While electronic detonators 48 are included in every explosive deck 46, this is not necessary in the presplit row, whose decks of explosive may be initiated by detonating cord within groups of ten holes while each group is initiated by an electronic detonator.

In this example, the number of holes per row is not specified, being a function of the overall size of blast to be fired along a mining strip. The first hole to be initiated is shown as the first hole of row A, but the direction of initiation along the blast may be chosen according to site conditions, especially such that the blast initiates in a direction away from any areas that present the highest concern in terms of vibration and/or airblast. Alternatively, the blast may be initiated from a central position in both directions, following the design principles described here.

In this example the strata and rows are charged as follows:

Stratum 1: Row A: ANFO explosive 250 kg. (Powder factor=0.2 kg/m$^3$)

Stratum 1: Row B and Row C: Heavy ANFO explosive 950 kg (Powder factor=0.75 kg/m$^3$)

Stratum 1: Row D: Heavy ANFO explosive 900 kg (Powder factor=0.62 kg/m$^3$)

Stratum 1: Row E and Row F: Heavy ANFO explosive 700 kg (Powder factor=0.55 kg/m$^3$)

Stratum 1: Row G (presplit): Waterproof emulsion explosive in toe deck 60 kg, ANFO explosive in mid and upper decks 50 kg with air decks in between the explosive decks (Presplit Powder factor=0.8 kg/m$^2$ of highwall area)

The explosive charges in stratum 1 are located 3 m above the top of the upper coal seam 38, being loaded onto inert stemming material, thus providing an inert "stand-off" distance between the coal seam and the bottom of the explosive charges to minimise movement of the coal seam as a result of the throw blast above.

Stratum 2: All rows: Nil explosive charge, inert stemming material is backfilled into the holes through the coal seam stratum 2. This layer of inert material extends below, as well as above, the coal seam for 3 m, with a greater layer of inert material below stratum 1 in row 1.

Stratum 3: Row A: Heavy ANFO explosive 280 kg. (Powder factor=0.30 kg/m$^3$)

Stratum 3: Row C: Heavy ANFO explosive 620 kg (Powder factor=0.33 kg/m$^3$)

Stratum 3: Row D: Heavy ANFO explosive 350 kg (Powder factor=0.33 kg/m$^3$)

Stratum 3: Row F: Heavy ANFO explosive 570 kg (Powder factor=0.30 kg/m$^3$)

Stratum 3: Row G (presplit): Loaded as described earlier

The explosive charges in stratum 3 are located 3 m above the top of the bottom coal seam 44, being loaded onto inert stemming material, thus providing an inert "stand-off" distance between the coal seam and the bottom of the explosive charges.

Stratum 4: Row A: Waterproof emulsion explosive 160 kg. (Powder factor=0.25 kg/m$^3$)

Stratum 4: Row C: Waterproof emulsion explosive 320 kg (Powder factor=0.25 kg/m$^3$)

Stratum 4: Row D: Waterproof emulsion explosive 180 kg (Powder factor=0.25 kg/m$^3$)

Stratum 4: Row F: Waterproof emulsion explosive 250 kg (Powder factor=0.20 kg/m$^3$)

Stratum 4: Row G (presplit): Loaded as described earlier

In this example the explosive charges in strata and rows are initiated as follows:

Stratum 1: Row A: Zero milliseconds between holes in groups of 5 holes, with 25 ms between groups.

Stratum 1: Row B and Row C: Row B commences 1500 ms after row A. Row C commences 300 ms after row B. Inter-hole delays of 10 ms are used in rows B and C.

Stratum 1: Row D: Row D commences 300 ms after row C. Inter-hole delays of 10 ms are used.

Stratum 1: Row E and Row F: Row E commences 300 ms after row D and row F commences 350 ms after row E. Inter-hole delays of 15 ms are used in row 5 and inter-hole delays of 25 ms are used in row F.

Stratum 1-4: Row G (presplit): All decks within the presplit holes fire on the same delay. The presplit row is initiated in groups of ten holes all on the same hole delay, with 25 ms between groups of ten holes. The first group of holes initiates 150 ms after the first hole in row B.

Stratum 3: Row C: Initiated 500 ms after the first charge in Stratum 1 row F. Inter-hole delays of 50 ms are used in this layer in row C. This row is the first row to fire in this layer in order to provide initial breakage in the central zone and ensure minimal movement of the stand-up sections of the blast towards the free face.

Stratum 3: Row D: Initiated 100 ms after the first charge in Stratum 3 row C. Inter-hole delays of 50 ms are used in this layer in row D.

Stratum 3: Row A: Initiated 150 ms after the first charge in Stratum 3 row C. Inter-hole delays of 50 ms are used in this layer in row A.

Stratum 3: Row F: Initiated 150 ms after the first charge in Stratum 3 row D. Inter-hole delays of 50 ms are used in this layer in row F.

Stratum 3: Row G (presplit): Already initiated as described earlier.

Stratum 4: Row C: Initiated 200 ms after the first charge in Stratum 3 row F. Inter-hole delays of 50 ms are used in this layer in row C.

Stratum 4: Row D: Initiated 100 ms after the first charge in Stratum 4 row C. Inter-hole delays of 50 ms are used in this layer in row D.

Stratum 4: Row A: Initiated 50 ms after the first charge in Stratum 4 row D. Inter-hole delays of 50 ms are used in this layer in row A.

Stratum 4: Row F: Initiated 150 ms after the first charge in Stratum 4 row D. Inter-hole delays of 50 ms are used in this layer in row F.

Stratum 4: Row G (presplit): Already initiated as described earlier.

This blast will yield the following:

1. A layer of buffering material from stratum 1 row A in front of the main (bottom) coal seam.
2. A substantial proportion of material from stratum 1 rows B, C, D and E thrown into a final spoil position, due to the combination of high powder factors, shorter inter-hole delays and longer inter-row delays, with initiation proceeding from the free face backwards into the blast block.
3. A presplit forming a clean highwall at the back of the entire blast block.
4. Stand-up blasts within strata 3 and 4, designed with lower powder factors, central initiation, longer inter-hole delays and shorter inter-row delays in contrast to stratum1, thus providing adequate breakage of material in strata 2, 3 and 4 to enable the excavation of the material and recovery of coal without substantial disruption or crushing of the coal seams, or dilution of the coal seams with the inter- or overburden material.

FIG. 7 shows an example of a blast in accordance with the invention with specific designs for differential fragmentation outcomes within each of the separate layers. For convenience the same reference numerals will be used as in FIG. 2 where appropriate. The same approach as used in FIGS. 6*a* and 6*b* will be used to identify rows of blastholes and individual blastholes within such rows. FIG. 7 shows an overburden layer 50 on top of a recoverable mineral layer 52. While this example only shows two layers, several layers may be involved, each with similarly differential designs in order to achieve differential fragmentation outcomes.

The overburden layer 50 has a blast designed to result in finer fragmentation for increased excavation productivity. By contrast, the recoverable mineral layer 52 has a blast designed for coarser fragmentation to produce more "lump" material, which has a higher value for some minerals such as coal and iron ore. The use of different inter-hole and inter-row (between adjacent rows) timing, as well as multiple in-hole initiation, all in combination with a higher powder factor in the overburden layer 50 as compared to that in the mineral layer 52, enable the differential fragmentation outcomes to be achieved.

In FIG. 7, there are six rows A-F of blastholes a-f. In this example, only four rows, namely rows A, C, D, and F, extend into the mineral layer 52. The nominal blasthole diameter is 270 mm and the nominal burden distances between rows and spacing distances between holes within rows are 7 m and 9 m respectively. The depth of the overburden layer is 40 m and that of the mineral layer is 10 m.

In this example, the number of holes per row is not specified, being a function of the overall size of blast to be fired along a mining strip. The first hole to be initiated is taken as the first hole of row A, however the direction of initiation along the blast may be chosen according to site conditions, especially such that the blast initiates in a direction away from any areas that present the highest concern in terms of vibration and/or airblast. Alternatively, the blast may be initiated from a central position in both directions, following the design principles described here.

In this example the strata and rows are charged as follows:

Stratum 1: Row A: Heavy ANFO explosive 2000 kg. (Powder factor=0.79 kg/m$^3$)

Stratum 1: Rows B, C, D and E: Heavy ANFO explosive 1800 kg (Powder factor=0.71 kg/m$^3$)

Stratum 1: Row F: ANFO explosive 1400 kg (Powder factor=0.56 kg/m$^3$)

The columns of explosive charges in stratum 1 are located 3 m above the top of the upper coal seam 52, being loaded onto inert stemming material 45, thus providing an inert "stand-off" distance between the coal seam and the bottom of the explosive charges.

Stratum 2: Row A: Heavy ANFO explosive 200 kg. (Powder factor=0.32 kg/m$^3$)

Stratum 2: Row C: Heavy ANFO explosive 400 kg (Powder factor=0.32 kg/m$^3$)

Stratum 2: Row D: ANFO explosive 150 kg (Powder factor=0.24 kg/m$^3$)

Stratum 2: Row F: Heavy ANFO explosive 400 kg (Powder factor=0.32 kg/m$^3$)

In this example the explosive charges in the strata and rows are initiated as follows:

In all blastholes in stratum 1, dual in-hole initiation is used. In this example, the "initiators" comprise an electronic detonator within a suitable primer. In stratum 1, the bottom initiator in each hole fires first, with firing of the top initiator delayed by 2 ms from the bottom initiator. This enabling detonation both downwards and upwards within each column of explosive within stratum 1.

Stratum 1: Row A: 12 ms delay between holes.

Stratum 1: Rows B, C, D and E: Row B commences 100 ms after row A. Rows C, D and E commence 150 ms after the preceding row. Inter-hole delays of 12 ms are used in rows B, C, D and E.

Stratum 1: Row F: Row F commences 150 ms after row E. Inter-hole delays of 26 ms are used in row F.

Stratum 2: Row C: Initiated 1500 ms after the last charge in Stratum 1 row F. Inter-hole delays of 60 ms are used in this layer in row C.

Stratum 2: Row D: Initiated 150 ms after the first charge in Stratum 2 row C. Inter-hole delays of 60 ms are used in this layer in row D.

Stratum 2: Row A: Initiated 150 ms after the first charge in Stratum 2 row D. Inter-hole delays of 60 ms are used in this layer in row A.

Stratum 2: Row F: Initiated 200 ms after the first charge in Stratum 2 row D. Inter-hole delays of 70 ms are used in this layer in row F.

This multilayer blast will yield finer fragmentation in the overburden layer in stratum 1 and coarser fragmentation with more "lump" material in the mineral layer in stratum 2.

In another example, the invention was implemented in a large strip coal mine in the following manner. A bench comprising a first body of material of depth 18 m, which consisted of a bottom coal seam of depth 2.8 m covered by a layer of interburden of depth 12 m overlaid by an upper coal seam of depth 3.2 m and a second body of material comprising overburden of depth 38 m, was drilled, loaded with explosives and initiators and blasted in one cycle.

The first body of material was subjected to a stand-up blast, which commenced about 7 seconds after the second body of material had been subjected to a throw blast. Different inter-hole and inter-row delay timing was used within the first body of material and the second body of material. The blasthole diameter was 270 mm, the burden ranged from 6 to 7.5 m and the spacing was 9 m. Accurate positioning of explosive charges and inert decks was achieved through 'gamma logging' of blastholes to accurately locate the positions of the coal seams. These were plotted in a three dimensional model in a blast design package. A sophisticated predictive blast model was then used to optimise the energy distribution of explosives in the various layers.

In this example, explosive was loaded into the bottom coal seam and the interburden layer above that in the first body of material and into the uppermost layer of overburden in the second body of material, above the upper coal seam. The upper coal seam in the first body of material was not loaded with explosive. Hence three separate strata, two in the first body of material, were loaded with explosives and initiators. Electronic detonators were used for blast initiation in all three layers blasted. The blast initiation timing design is shown in FIG. 8 using the same approach as FIG. 6*a* to identity rows of blastholes and individual blastholes within the rows. The firing times for the electronic detonators are shown alongside each hole. The firing times refer, reading from top to bottom, to the uppermost explosive deck in the overburden throw blast, the explosive deck in the interburden stand-up blast and the explosive deck in the bottom coal seam stand up blast. While FIG. 8 shows the initiation pattern, it only shows the first few holes of the entire blast field. The total duration of the "multiple blast" throughout the blast field was 11180 ms. The blast was successfully fired and the following results were achieved:

1. A higher percentage of material thrown clear of the blast field was achieved, at 45.5% as compared to the 25% conventionally achieved;
2. The material from the throw blast was efficiently excavated by a dragline indicating suitable fragmentation and swell;
3. When excavated, the coal loss and damage were minimal and the coal recovery was higher than achieved conventionally;
4. The drill, load and blast cycles were reduced from four separate cycles to one, representing a major gain in productivity for the mine; and
5. The reduction in the number of blast events from four to one, meaning reduced environmental impact from noise, vibration and dust.

Those skilled in the art will appreciate that the invention described herein is susceptible to variations and modifications other than those specifically described. It is to be understood that the invention includes all such variations and modifications which fall within the spirit and scope. The invention also includes all of the steps, features, compositions and compounds referred to or indicated in this specification, individually or collectively, and any and all combinations of any two or more of said steps or features.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that prior art forms part of the common general knowledge in Australia.

What is claimed is:

1. In open cut mining for recoverable mineral, a method of blasting plural layers of material in a blast field including a first body of material comprising at least a first layer of material and a second body of material comprising at least a second layer of material over the first body of material, the method comprising:

drilling rows of blastholes through the second body of material and, for at least a plurality of the blastholes, at least into the first body of material, loading the blastholes with explosives, in which at least a plurality of the blastholes that extend into the first body of material are loaded with a respective deck of explosives in each of the first and second bodies of material, and firing the explosives in the first and second bodies of material in a single cycle of drilling, loading and blasting at least the first and second bodies of material and configuring delay times of detonators of the explosives in the first and second bodies of material in a manner to subject the second body of material to a blast of different design compared to the blast of the first body of material and to produce a different blast outcome in the second body of material compared to that in the first body of material, wherein configuring delay times of the detonators of the explosives in the first and second bodies of material in each blasthole to produce the blast of different design comprises providing in said at least a plurality of the blastholes having a respective deck of explosives in each of the first and second bodies of material at least one of 1), between adjacent rows, different inter-row blasthole delay times of the detonators for the explosives in the second body of material relative to the detonators for the explosives in the first body of material, wherein the different inter-row blasthole delay times comprise, for at least two blastholes in adjacent rows having a respective deck of explosive in each of the first and second bodies of material, a first delay time between initiation of a deck of explosive in the second body of material in one blasthole in one row and initiation of a deck of explosive in the second body of material in an adjacent blasthole in any adjacent row which is different from a second delay time between initiation of a deck of explosive in the first body of material in the one blasthole and initiation of a deck of explosive in the first body of material in the adjacent blasthole or 2), in any one row, different inter-hole blasthole delay times of the detonators for the explosives in the second body of material relative to the detonators for the explosives in the first body of material, wherein the different inter-hole blasthole delay times comprise, for at least two blastholes in the same row having a respective deck of explosive in each of the first and second bodies of material, a first delay time between initiation of a deck of explosive in the second body of material in one blasthole in the row and initiation of a deck of explosive in the second body of material in another blasthole in the same row which is different from a second delay time between initiation of a deck of explosive in the first body of material in the one blasthole in the row and initiation of a deck of explosive in the first body of material in the other blasthole in the same row.

2. A method of blasting according to claim 1, wherein blasting is of plural strata of material in which the first body of material comprises at least a first stratum of material and the second body of material comprises at least a stratum of overburden over the first body of material.

3. A method of blasting according to claim 1, wherein the blasts of different design in the first and second bodies of material achieve differential fragmentation between the two bodies of material.

4. A method of blasting according to claim 2, wherein the second body of material consists essentially of the stratum of overburden.

5. A method of blasting according to claim 4, wherein the explosives in the second body of material are spaced from the bottom of the second body of material.

6. A method of blasting according to claim 1, wherein the explosives in the second body of material in each of at least some of the blastholes are provided as a main column of explosives and as a further deck of explosives spaced from and beneath the main column, said further deck of explosives being smaller than the main column of explosives.

7. A method of blasting according to claim 6, wherein the further deck of explosives is fired on a different delay to the main column.

8. A method of blasting according to claim 2, wherein the first body of material comprises at least two strata of recoverable mineral and at least one stratum of interburden therebetween.

9. A method of blasting according to claim 8, wherein the explosives in the first body of material are disposed only in the at least one stratum of interburden.

10. A method of blasting according to claim 9, wherein the explosives in the interburden are spaced from the strata of recoverable mineral.

11. A method of blasting according to claim 10, wherein the blastholes are not drilled into the lowermost strata of recoverable mineral in the first body of material.

12. A method of blasting according to claim 9, wherein the explosives in the interburden in each of at least some of the blastholes are provided as a main column of explosives and as a further deck of explosives spaced from and beneath the main column, said further deck of explosives being smaller than the main column of explosives.

13. A method of blasting according to claim 12, wherein the further deck of explosives is fired on a different delay to the main column.

14. A method of blasting according to claim 1, wherein not all of the blastholes in the second body of material extend into the first body of material.

15. A method of blasting according to claim 14, wherein at least some of the blastholes only in the second body of material do not extend to the bottom of the second body of material.

16. A method of blasting according to claim 2, wherein a third body of material is disposed between the first and second bodies of material, the third body of material comprising at least one stratum of burden or recoverable mineral, and wherein the third body of material is subjected to a blast in said single cycle of different design to the blast to which at least one of the first or second body of material is subjected in said single cycle.

17. A method of blasting according to claim 1, wherein the explosives in blastholes in the first body of material are initiated from the back of the blast, i.e. remote from the location of the free face, towards the front of the blast, i.e. adjacent the location of the free face.

18. A method of blasting according to claim 1, wherein the explosives in blastholes in one or both of the first and second bodies of material have an initiation point remote from edges of the blast field.

19. A method of blasting according to claim 1, wherein the blast in said one or both of the first and second bodies of material proceeds in multiple directions from said initiation point.

20. A method of blasting according to claim 1, wherein the blast field has a free face at the level of the second body of material and wherein the explosives in blastholes in the second body of material adjacent the back of the blast, i.e. remote from the location of the free face, are initiated before the explosives in blastholes in the second body of material further forward, i.e. closer to the location of the free face.

21. A method of blasting according to claim 1, wherein in said single cycle the blast in the first body of material is initiated after initiation of the blast in the second body of material.

22. A method of blasting according to claim 21, wherein the delay between initiation of the blast in the second body of material and initiation of the blast in the first body of material is about 40 seconds or less.

23. A method of blasting according to claim 22, wherein said delay is in the range of about 500 to 25000 ms.

24. A method of blasting according to claim 1, wherein in said single cycle the blast in the first body of material is initiated before initiation of the blast in the second body of material.

25. A method of blasting according to claim 1, wherein the explosives in the blast field are initiated by an electronic detonator delay system.

26. A method of blasting according to claim 1, wherein said loading and blasting in said single cycle are preceded by blast-hole logging to determine the location of any stratum of recoverable mineral in each blasthole.

27. A method of blasting according to claim 26, wherein the blasthole logging comprises gamma-ray logging.

28. A method of blasting according to claim 1, wherein the blast in the second body of material and the blast in the first body of material have additional different blast design features selected from one or more of blasthole pattern, explosive type, explosive density, blast-hole loading configuration, explosive mass, powder factor, stemming and buffering.

29. A method of blasting according to claim 2, wherein said first stratum of material is recoverable mineral.

* * * * *